US008352228B2

(12) United States Patent
Walters et al.

(10) Patent No.: US 8,352,228 B2
(45) Date of Patent: Jan. 8, 2013

(54) METHOD FOR PREDICTING PETROLEUM EXPULSION

(75) Inventors: Clifford C. Walters, Milford, NJ (US); Howard Freund, Neshanic Station, NJ (US); Simon R. Kelemen, Annandale, NJ (US); Mehmet Deniz Ertas, Bethlehem, PA (US); William Symington, Houston, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 469 days.

(21) Appl. No.: 12/571,937

(22) Filed: Oct. 1, 2009

(65) Prior Publication Data

US 2010/0161302 A1 Jun. 24, 2010

Related U.S. Application Data

(60) Provisional application No. 61/140,246, filed on Dec. 23, 2008.

(51) Int. Cl.
*G06G 7/48* (2006.01)
*G06G 7/58* (2006.01)

(52) U.S. Cl. ..... 703/10; 703/12

(58) Field of Classification Search ..... 703/10, 703/12; 702/6

See application file for complete search history.

(56) References Cited

U.S. PATENT DOCUMENTS 5,040,414 A 8/1991 Graebner
5,159,833 A 11/1992 Graebner
5,586,082 A 12/1996 Anderson et al.
5,757,663 A 5/1998 Lo et al.
5,774,381 A 6/1998 Meier
5,798,982 A 8/1998 He et al.
5,835,882 A 11/1998 Vienot et al.
5,905,657 A * 5/1999 Celniker ..... 703/5
6,013,172 A 1/2000 Chang et al.
6,246,963 B1 6/2001 Cross et al.
6,393,906 B1 5/2002 Vityk et al.
6,514,915 B1 2/2003 Beyer et al.
6,661,000 B2 12/2003 Smith et al.
6,754,588 B2 6/2004 Cross et al.

(Continued)

FOREIGN PATENT DOCUMENTS

GB 2 145 508 A 12/2005

(Continued)

OTHER PUBLICATIONS

Kelemen, S.R. et al.,"Petroleum Expulsion Part 3. A Model of Chemically Driven Fractionation during Expulsion of Petroleum from Kerogen", Jan. 5, 2006, Energy & Fields 2006, 20, American Chemical Society.*

(Continued)

*Primary Examiner* — Kandasamy Thangavelu
*Assistant Examiner* — Cedric D Johnson
(74) *Attorney, Agent, or Firm* — ExxonMobil Upstream Research Company Law Department

(57) ABSTRACT

A method for predicting petroleum production is provided. An exemplary embodiment of The computer-implemented comprises computing a first approximation of an amount of generated petroleum that is retained with a complex organic product using a Threshold and a Maximum Retention value. The exemplary method also comprises revising the first approximation by approximating a process of chemical fractionation using at least one partition factor to create a revised approximation and predicting petroleum production based on the revised approximation.

20 Claims, 10 Drawing Sheets

U.S. PATENT DOCUMENTS

| | | | |
|---|---|---|---|
| 6,810,332 | B2 | 10/2004 | Harrison |
| 6,826,483 | B1 | 11/2004 | Anderson et al. |
| 6,950,751 | B2 | 9/2005 | Knobloch |
| 6,985,841 | B2 | 1/2006 | Barroux |
| 7,124,030 | B2 | 10/2006 | Ellis |
| 7,174,254 | B2 | 2/2007 | Ellis |
| 7,210,342 | B1 | 5/2007 | Sterner et al. |
| 7,249,009 | B2 | 7/2007 | Ferworn et al. |
| 7,297,661 | B2 | 11/2007 | Beyer et al. |
| 7,337,660 | B2 | 3/2008 | Ibrahim et al. |
| 7,344,889 | B2 | 3/2008 | Kelemen |
| 7,387,021 | B2 | 6/2008 | DiFoggio |
| 7,395,691 | B2 | 7/2008 | Sterner et al. |
| 7,520,158 | B2 | 4/2009 | DiFoggio |
| 7,526,418 | B2 | 4/2009 | Pita et al. |
| 7,529,626 | B1 | 5/2009 | Ellis |
| 2002/0013687 | A1 | 1/2002 | Ortoleva |
| 2002/0049575 | A1 | 4/2002 | Jalali |
| 2002/0067373 | A1 | 6/2002 | Roe |
| 2002/0099504 | A1 | 7/2002 | Cross |
| 2002/0120429 | A1 | 8/2002 | Ortoleva |
| 2004/0148147 | A1 | 7/2004 | Martin |
| 2004/0210547 | A1 | 10/2004 | Wentland et al. |
| 2004/0220790 | A1 | 11/2004 | Cullick et al. |
| 2004/0254734 | A1 | 12/2004 | Zabalza-Mezghani |
| 2005/0096893 | A1 | 5/2005 | Feraille |
| 2005/0149307 | A1 | 7/2005 | Gurpinar |
| 2005/0199391 | A1 | 9/2005 | Cudmore |
| 2005/0209866 | A1 | 9/2005 | Veeningen |
| 2005/0209912 | A1 | 9/2005 | Veeningen |
| 2005/0234690 | A1 | 10/2005 | Mainguy et al. |
| 2005/0256647 | A1 | 11/2005 | Ellis |
| 2006/0014647 | A1 | 1/2006 | Beyer et al. |
| 2006/0041409 | A1 | 2/2006 | Strebelle |
| 2006/0047489 | A1 | 3/2006 | Scheidt et al. |
| 2006/0052938 | A1 | 3/2006 | Thorne |
| 2006/0092766 | A1 | 5/2006 | Shelley |
| 2006/0235667 | A1 | 10/2006 | Fung et al. |
| 2006/0235668 | A1 | 10/2006 | Swanson et al. |
| 2006/0241867 | A1 | 10/2006 | Kuchuk |
| 2006/0265204 | A1 | 11/2006 | Wallis |
| 2006/0277012 | A1 | 12/2006 | Ricard et al. |
| 2006/0277013 | A1 | 12/2006 | Bennis |
| 2006/0282243 | A1 | 12/2006 | Childs et al. |
| 2006/0287201 | A1 | 12/2006 | Georgi |
| 2006/0293872 | A1 | 12/2006 | Zamora |
| 2007/0005253 | A1 | 1/2007 | Fornel |
| 2007/0011646 | A1 | 1/2007 | Chrisochoides |
| 2007/0013690 | A1 | 1/2007 | Grimaud |
| 2007/0016389 | A1 | 1/2007 | Ozgen |
| 2007/0143024 | A1 | 6/2007 | Michel |
| 2007/0156377 | A1 | 7/2007 | Gurpinar |
| 2007/0219724 | A1 | 9/2007 | Li et al. |
| 2007/0219725 | A1 | 9/2007 | Sun |
| 2007/0242564 | A1 | 10/2007 | Devi |
| 2007/0265778 | A1 | 11/2007 | Suter |
| 2008/0040086 | A1 | 2/2008 | Betancourt et al. |
| 2008/0059140 | A1 | 3/2008 | Salmon et al. |
| 2008/0097735 | A1 | 4/2008 | Ibrahim et al. |
| 2008/0099241 | A1 | 5/2008 | Ibrahim et al. |
| 2008/0147326 | A1 | 6/2008 | Ellis |
| 2008/0173804 | A1 | 7/2008 | Indo et al. |
| 2009/0071239 | A1 | 3/2009 | Rojas et al. |

FOREIGN PATENT DOCUMENTS

| | | |
|---|---|---|
| WO | WO 83/03676 | 10/1983 |
| WO | WO03/093815 | 11/2003 |
| WO | WO2004/102156 | 11/2004 |
| WO | WO2007/007210 | 1/2007 |
| WO | WO2007/063442 | 6/2007 |
| WO | WO2008/100614 | 8/2008 |
| WO | WO2009/094064 | 7/2009 |
| WO | WO2010/008647 | 1/2010 |

OTHER PUBLICATIONS

Freund, Howard et al., Predicting Oil and Gas Compositional Yields via Chemical Structure—Chemical Yield Modeling (CS-CYM): Part 1—Concepts and Implementation, Dec. 12, 2006, Organic Geochemistry 38, Elsevier Ltd.*

Barton, A.F.M., (1991) "CRC Handbook of Solubility Parameters and Other Cohesive Parameters" CRC Press, Boca Raton, Fl., Chpt. 4, pp. 58-66.

Behar, F., et al., (2007) "New IFP compositional kinetics of oil generation and degradation" AAPG Hedberg Research Conference (The Hague, The Netherlands, May 6-9, 2007).

Duppenbecker, S.J., et al., (1991) "Numerical modeling of petroleum expulsion in two areas of the Lower Saxony Basin, northern Germany" *Petroleum migration, Geological Society Special Publications 59*, 59 W.A. England, A.J. Fleet, ed., Geological Society of London, London, United Kingdom, pp. 47-64.

Durand, B., et al., (1987) "Oil saturation and primary migration; observations in shales and coals from the Kerbau wells, Mahakam Delta, Indonesia" In: *Migration of Hydrocarbons in Sedimentary Basins, 2nd IFP Exploration Research Conference*, 45 B. Doligez, ed., Technip, Paris, France, Carcans, France, pp. 173-195.

Espitalié, J., et al., (1993) "Critical study of kinetic modelling parameters" In: A.G. Dore, J.H. Augustson, C. Hermanrud and D.J. Stewart (Eds.), Basin Modelling: Advances and Applications, Norwegian Petroleum Society' Special Publication 3. Elsevier, pp. 233-242.

Fedors, R.F. (1974), "A Method for Estimating Both the Solubility Parameters and Molar Volumes of Liquids", Polymer Engineering & Science, v. 14, No. 2, pp. 147-155.

Flory, P.J., (1953) Principles of Polymer Chemistry. Cornell University Press, Ithaca, NY, pp. 576-581.

Freund, H., et al., (2005) "Predicting Oil and Gas Compositional Yields from First Principles, chemical yield modeling (CSCYM), Part 1, Concepts & Implementation" Organic Chemistry, 38, pp. 288-305.

Hansen, C.M., (1967) "The three dimensional solubility parameter—key to paint component affinities: I. Solvents plasticizers, polymers, and resins" Journal of Paint Technology 3, pp. 104-117.

Hsieh, S.T., Duda, J.L., (1987) "Probing coal structure with organic vapor sorption" Fuel 66, 170-178.

Isaacs, C.M., (2001) "Depositional framework of the Monterey Formation, California" *The Monterey Formation: From Rocks to Molecules* C.M. Isaacs, J. Rullkötter, ed., Columbia University Press, New York, pp. 1-30.

Justwan, H.K., et al., (2008) "Unraveling dynamic fluid connectivity through time-lapse geochemistry—from example from the Ringhorne Field, Norway," AAPG Int'l. Conf and Exhibition, Cape Town, South Africa.

Lafargue, E., et al., (1994). "Experimental simulation of primary migration" Organic Geochemistry 22, pp. 575-586.

Larsen, J.W., et al., (1990) "Solvent swelling studies of two low-rank coals" Energy & Fuels 4, pp. 74-77.

Larsen, J.W., et al., (1994) "Solvent swelling studies of Green River kerogen" Energy & Fuels 8, pp. 932-936.

Lucht, L.M., et al., (1987) "Macromolecular structure of coals .3. Equilibrium swelling of coal particles in various solvents". Erdol & Kohle Erdgas Petrochemie 40, pp. 483-485.

Mann, U., (1990) "Sedimentological and petrophysical aspects of primary petroleum migration pathways" In: *Sediments and environmental geochemistry; selected aspects and case histories* D. Heling, P. Rothe, U. Foerstner, P. Stoffers, ed., pp. 152-178. Springer-Verlag, Berlin, Federal Republic of Germany.

Mann, U., et al., (1991) "Pore network evolution of the Lower Toarcian Posidonia Shale during petroleum generation and expulsion; a multidisciplinary approach. New approaches in exploration geology" Kontaktwochenende/Rheinisch-Westfaelische Technische Hochschule Aachen; New approaches in exploration geology 1990, pp. 1051-1071.

Palciauskas, V.V., et al., (1991) "Primary migration of petroleum Source and migration processes and evaluation techniques" AAPG treatise of petroleum geology; handbook of petroleum geology. Am. Assoc. Pet. Geol., Tulsa, OK, United States, Chapter 2, pp. 13-22.

Sanada, Y., Honda, H., (1966) "Swelling equilibrium of coal by pyridine at 25°" Fuel 45, pp. 295-300.

Sassen, R., et al., (1987) "Distribution of hydrocarbon source potential in the Jurassic Smackover Formation" Organic Geochemistry 11, pp. 379-383.
Talukdar, S.N., et al., (1987) "Observations on the primary migration of oil in the La Luna source rocks of the Maracaibo Basin, Venezuela. Migration of hydrocarbons in sedimentary basins" 2nd IFP exploration research conference 45, pp. 59-77.
Tissot, B. P. et al., (1984) "Petroleum Formation and Occurrence", second edition, Springer-Verlag, Berlin, pp. 151.
Tissot, B., (1987) "Migration of hydrocarbons in sedimentary basins; a geological, geochemical and historical perspective". *Migration of Hydrocarbons in Sedimentary Basins, 2nd IFP Exploration Research Conference*, 45 B. Doligez, ed., Technip, Paris, France, Carcans, France, pp. 1-19.
Welte D. H., et al., (1997) "Petroleum and Basin Evolution: Insights from Petroleum Geochemistry", Geology and Basin Modeling, Springer, pp.
Sandvik, E.I., et al., (1992) "Expulsion from hydrocarbon sources; the role of organic absorption. Advances in organic geochemistry 1991; Part 1, Advances and applications in energy and the natural environment" Proceedings of the 15th international meeting on Organic geochemistry 19, 77-87.
Snedden, J.W. et al., (2007) "Reservoir Connectivity: Definitions, Examples, and strategies," IPTC Conference proceedings Dubai, U.A.E., No. 11375, pp. 1-22.
Stainforth, J.G., et al., (1990) "Primary migration of hydrocarbons by diffusion through organic matter networks, and its effect on oil and gas generation" Organic Geochemistry 16, 61-74.
Stainforth, et al (2009) "Practical kinetic modeling of petroleum generation and expulsion" Marine and Petroleum Geology, Gutterworth Scientific, Guildford, GB vol. 26, No. 4 pp. 552-572 ISSN: 0264-8172.
Sumpter, L. et al., (2008) "Early Recognition of Potential Reservoir Compartmentalization," Reservoir Compartmentalization, London Geological Society, Mar. 5-6, 2008, p. 84.
Sweeney, J.J., et al., (1995) "Chemical kinetic model of hydrocarbon generation, expulsion, and destruction applied to the Maracaibo Basin" Venezuela American Association of Petroleum Geologists Bulletin 79, 1515-1531.
Sweet, M.L., et al., (2007) "Genesis Field, Gulf of Mexico: Recognizing Reservoir Compartments on geologic and production time scales in deep-water reservoirs," AAPG Bulletin, vol. 91 No. 12, pp. 1701-1729.
Tang, Y., et al., (1994) "Multiple cold trap pyrolysis-gas chromatography—a new technique for modeling hydrocarbon generation". Organic Geochemistry 22, 863-872.
Thomas, M.M., et al., (1990) "Primary migration by diffusion through kerogen; III, Calculation of geologic fluxes" Geochimica et Cosmochimica Acta 54, 2793-2797.
Ungerer, P., (1990) "State-of-the-art of research in kinetic modeling of oil formation and expulsion" Organic Geochemistry 16, 1-25.
Ungerer, P., (2003) "From Organic Geochemistry to Statistical Thermodynamics: the Development of Simulation Methods for the Petroleum Industry", Oil and Gas science and Technology—Rev. IFP, vol. 58 (2003) No. 2 pp. 271-297.
Walters, C.C., et al., (2007) Predicting oil and gas compositional yields via chemical structure-chemical yield modeling (CS-CYM): Part 2—Application under laboratory and geologic conditions. Organic Geochemistry 38, 306-322.
Wendebourg, J. (2000), "Modeling multi-component petroleum fluid migration in sedimentary basins", Journal of Geochemical Exploration 69-70, 651-656.
Young, A., et al., (1977). "Distribution of hydrocarbons between oils and associated fine-grained sedimentary rocks-physical chemistry applied to petroleum geochemistry" II. American Association of Petroleum Geologists Bulletin 61, 1407-1436.
European Search Report (Extended) EP 09 15 7938 for Application No. 09157938.3-1266 dated Oct. 29, 2009.
European Search Report (Extended) EP 09 15 7938 for Application No. 09157939.1-1266 dated Oct. 7, 2009.
U.S. Appl. No. 12/573,428, filed Oct. 5, 2009.
U.S. Appl. No. 12/571,937, filed Oct. 1, 2009.
Al Darouich, T., et al., (2006) "Thermal cracking of the light aromatic fraction of Safaniya crude oil—Experimental study and compositional modelling of molecular classes" Organic Geochemistry 37, 1130-1154.
Andresen, B., et al., (1993) "Yields and carbon isotopic composition of pyrolysis products from artificial maturation processes" Chemical Geology 106, 103-119.
Barker, C., (1972) "Aquathermal pressuring: role of temperature in development of abnormal pressure zones" American Association of Petroleum Geologists Bulletin 56, 2068-2071.
Behar, F., et al., (1991) "Experimental simulation in a confined system and kinetic modelling of kerogen and oil cracking" Organic Geochemistry 19, 173-189.
Behar, F., et al., (1995) "Experimental simulation of gas generation from coals and a marine kerogen" Chemical Geology 126, 247-260.
Behar, F., et al., (1997) "Comparison of rate constants for some molecular tracers generated during artificial maturation of kerogens: influence of kerogen type" Organic Geochemistry 26, 281-287.
Behar, F., et al., (1997) "Thermal cracking of kerogen in open and closed systems: determination of kinetic parameters and stoichiometric coefficients for oil and gas generation" Organic Geochemistry 26, 321-339.
Behar, F., et al., (2002) Thermal stability of alkylaromatics in natural systems: Kinetics of thermal decomposition of dodecylbenzene. Energy & Fuels 16, 831-841.
Braun, R.L., et al., (1991) "Pyrolysis kinetics for lacustrine and marine source rocks by programmed micropyrolysis" Energy & Fuels 5, 192-204.
Braun, R.L.,Burnham, A.K., (1992) "PMOD; a flexible model of oil and gas generation, cracking, and expulsion" Organic Geochemistry 19, 161-172.
Burnham, A. K. et al., (1990) "Development of a detailed model of petroleum formation, destruction, and expulsion from lacustrine and marine source rocks" Organic Geochemistry 16, 27-39.
Burnham, A.K., et al., (1999) "Global kinetic analysis of complex materials" Energy & Fuels 13, 1-22.
Cook, A.C., et al., (1991) "Classification of oil shales, coals and other organic-rich rocks" Organic Geochemistry 17, 211-222.
Curry, D.J., et al., (2005) "An integrated multi-component model for petroleum generation and cracking" Book of Abstracts, EAOG 22nd International Meetings on Organic Geochemistry. Seville, Spain, Sep. 12-16, 2005.
Dartiguelongue, C., et al., (2006) "Thermal stability of dibenzothiophene in closed system pyrolysis: Experimental study and kinetic modeling" Organic Geochemistry 37, 98-116.
Dieckmann, V., et al., (1998) "Kinetics of petroleum generation and cracking by programmed temperature closed-system pyrolysis of Toarcian shales" Fuel, 77, 23-31.
Dieckmann, V., et al. (2004) Predicting the composition of natural gas generated by the Duvernay Formation (Western Canada Sedimentary Basin) using a compositional kinetic approach, Organic Geochemistry 35, 845-962.
Dieckmann, V., et al., (2006) "A new approach to bridge the effect of organofacies variations on kinetic modelling and geological extrapolations" Organic Geochemistry 37, 728-739.
di Primio, R., et al., (2006) "From petroleum-type organofacies to hydrocarbon phase prediction" American Association of Petroleum Geologist Bulletin 90, 1031-1058.
England, W.A., et al., (1987) "The movement and entrapment of petroleum fluids in the subsurface" Journal of the Geological Society London 144, 327-347.
Ertas, D., et al., (2006) "Petroleum expulsion Part 1. Theory of kerogen swelling in multicomponent solvents" Energy & Fuels 20, 295-300.
Fouch, T.D., et al., (1994). "Green River petroleum system, Uinta Basin, Utah, U.S.A" In: L.B. Magoon and W.G. Dow (Eds.), The Petroleum System; From Source to Trap. AAPG Memoir. American Association of Petroleum Geologists, Tulsa, OK, United States, pp. 399-421.
Freund, H., (1992) "Application of a detailed chemical kinetic model to kerogen maturation" Energy & Fuels 6, 318-326.

Freund, H., et al., (2007), "Predicting oil and gas compositional yields via chemical structure-chemical yield modeling (CS-CYM): Part 1 Concepts and implementation", Organic Geochemistry 38, 288-305.
Horsfield, B., et al., (1992) "An investigation of the in-reservoir conversion of oil to gas: Compositional and kinetic findings from closed-system programmed-temperature pyrolysis" Organic Geochemistry, 19, 191-204.
Hunt, J.M., (1987) "Primary and secondary migration of oil: Exploration for heavy crude oil and natural bitumen. In: Exploration for heavy crude oil and natural bitumen" 25 (Ed. By R.F. Meyer), pp. 345-349. American Association of Petroleum Geologists, Tulsa, OK, United States, Santa Maria, CA, United States.
Hunt, J.M., (1990) "Generation and migration of petroleum from abnormally pressured fluid compartments" American Association of Petroleum Geologists Bulletin 74, 1-12.
Jarvie, D.M., (1991) "Factors affecting Rock-Eval derived kinetic parameters" Chemical Geology 93, 79-99.
Justwan, H., et al., (2008) "Characterization of Static and Dynamic Reservoir Connectivity for the Ringhorne Field, through integration of Geochemical and engineering data: Reservoir compartmentalization."
Kelemen, S.R., et al., (2005) "Chemical Fractionation During Expulsion Explained by Selectivity Solubility" Oral Presentation in EAOG 22$^{nd}$ International Meetings on Organic Geochemistry. Seville, Spain, Sep. 12-16, 2005.
Kelemen, S.R., et al., (2006) "Petroleum expulsion Part 2. organic matter type and maturity effects on kerogen swelling by solvents and thermodynamic parameters for kerogen from regular solution theory", Energy & Fuels 20, 301-308.
Kelemen, S.R., et al., (2006) "Petroleum expulsion Part 3. A model of chemically driven fractionation during expulsion of petroleum from kerogen". Energy & Fuels 20, 309-319.
Khavari-Khorasani, G., et al., (1998) "The factors controlling the abundance and migration of heavy versus light oils, as constrained by data from the Gulf of Suez. Part I. The effect of expelled petroleum composition, PVT properties and petroleum system geometry". Organic Geochemistry 29, 255-282.
Larsen, J.W., et al., (1985) "The nature of the macromolecular network structure of bituminous coals" Journal of Organic Chemistry 50, 4729-4735.
Larsen, J.W., et al., (1991) "Solvent extraction of coals during analytical solvent swelling. A potential source of error" Energy & Fuels 5, 57-59.
Larsen, J.W., et al., (1997) "Changes in the macromolecular structure of a Type I kerogen during maturation" Energy & Fuels 11, 897-901.
Larsen, J.W., et al., (1997) "An initial comparison of the interactions of Type I and III kerogens with organic liquids" Organic Geochemistry 26, 305-309.
Lewan, M.D., et al., (2002) "Comparison of petroleum generation kinetics by isothermal hydrous and nonisothermal open-system pyrolysis" Organic Geochemistry 33, 1457-1475.
Leythaeuser, D et al., (1991) "Expulsion of petroleum from type III kerogen source rocks in gaseous solution; modeling of solubility fractionation" *Petroleum Migration, Geological Society Special Publication 59*, 59 W.A. England, A.J. Fleet, ed., pp. 33-46. Geological Society of London, London, United Kingdom.
Liu, J.Z., et al., (1997) "Kinetics of petroleum generation determined from multiple cold trap pyrolysis gas chromatography" Chinese Science Bulletin 42, 254-258.
Manzocchi, et al., (2008) "Sensitivity of the impact of geological uncertainty on production from faulted and unfaulted shallow-marine oil reservoirs: objectives and methods," Petroleum Geoscience, [Online], vol. 14, Feb. 2008, pp. 3-15, XP0024998778.
Palacas, J.G., (1984) "Carbonate rocks as sources of petroleum: Geological and chemical characteristics and oil-source correlations" Proceedings of the Eleventh World Petroleum Congress 1983, London 2, 31-43.
Pepper, A.S., (1991) Estimating the petroleum expulsion behaviour of source rocks; a novel quantitative approach. In: W.A. England and A.J. Fleet (Editors), Petroleum migration, Geological Society Special Publications 59. Geological Society of London, London, United Kingdom, pp. 9-32.
Pepper, A. S., et al., (1995) "Simple kinetic models of petroleum formation; Part III, Modelling an open system", Marine and Petroleum Geology 12, 417-452.
Peters, K.E., et al., (2006) "Evaluation of kinetic uncertainty in numerical models of petroleum generation" American Association of Petroleum Geologists Bulletin 90, 387-403.
Philippi, G.T., (1965) "On the depth, time and mechanism of petroleum generation" Geochimica et Cosmochimica Acta 29, 1021-1049.
Price, L.C., (1989) "Primary petroleum migration from shales with oxygen-rich organic matter" Journal of Petroleum Geology 12, 289-324.
Richards, B., et al., (2008) "Reservoir Connectivity Analysis of a Complex Combination Trap Terra Nova Field, Jeanne d'Arc Basin, Newfoundland, Canada," Reservoir Compartmentalization, London Geological Society, Mar. 5-6, 2008, p. 59.
Ritter, U., (2003) "Solubility of petroleum compounds in kerogen: implications for petroleum expulsion" Organic Geochemistry 34, 319-326.
Ritter, U., et al., (2005) "Adsorption of petroleum compounds in vitrinite: implications for petroleum expulsion from coal" International Journal of Coal Geology 62, 183-191.
Gainski, M. et al., (2008) "The schiehallion field: detection of reservoir compartmentalisation and identification of new infill targets using 4D seismic surveys and dynamic production data," Reservoir Compartmentalization, [Online], Mar. 5-6, 2008, p. 32, XP002498777. Retrieved from the Internet.

* cited by examiner

METHOD FOR PREDICTING PETROLEUM EXPULSION

CROSS-REFERENCE TO RELATED APPLICATION

This application claims the benefit of U.S. Provisional Patent Application 61/140,246 filed Dec. 23, 2008 entitled METHOD FOR PREDICTING PETROLEUM EXPULSION, the entirety of which is incorporated by reference herein.

FIELD OF THE INVENTION

Exemplary embodiments of the present invention relate to a method for predicting petroleum production.

BACKGROUND OF THE INVENTION

This section is intended to introduce various aspects of the art, which may be associated with exemplary embodiments of the present invention. This discussion is believed to assist in providing a framework to facilitate a better understanding of particular aspects of the present invention. Accordingly, it should be understood that this section should be read in this light, and not necessarily as admissions of prior art.

Primary migration of petroleum compounds may be defined as the release of petroleum compounds from kerogen and their transport within and through narrow pores of a fine-grain source rock. Kerogen is solid, carbonaceous material found in sedimentary rocks. When kerogen comprises around ten weight percent or greater of the rock, the mixture is referred to as oil shale. This is true whether or not the mineral is, in fact, technically shale, that is, a rock formed from compacted clay. Kerogens, and the sediments that contain them, can comprise what is known as hydrocarbon source rock. Kerogen is chemically altered upon exposure to heat over a period of time. Upon heating, kerogen molecularly decomposes to produce oil, gas, and carbonaceous coke. Small amounts of water also may be generated. The oil, gas and water fluids are mobile within the rock matrix, while the carbonaceous coke remains essentially immobile.

Petroleum expulsion from their source rocks is the initial step in the migration process, during which the composition of the expelled petroleum is enriched in saturated and aromatic hydrocarbons while the retained bitumen is enriched in asphaltene and polar compounds. Numerous physical and chemical models have been proposed to explain petroleum expulsion and chemical fractionation; and, until recently, were largely empirical. The uncertainty in the fundamental principles and geochemical constraints of these processes contrasts with the considerable advances made in the understanding of source rock deposition, kerogen compositions, kinetics and mechanisms of petroleum generation and reservoir alteration processes.

Many expulsion models target the chemical or physical processes of oil moving within the source rock mineral matrix as the rate-determining step. Some considered the amount and type of organic matter as being critical to generating sufficient bitumen to exceed a saturation threshold. The establishment of effective and continuous migration pathways within the source rocks may be considered to be critical. Other models have considered pressure build-up from generation and compaction and the failure of the rock fabric forming micro-fracturing as a key element in expulsion. Still others have evoked gas availability and movement of oil in a gas or supercritical phase or movement of oil in an aqueous phase. These elements are controlled mostly by the sedimentary conditions during source rock deposition and by secondary diagenetic processes that occur during the evolution of sedimentary basins; consequently, the mechanisms that define oil movement will differ according to the lithofacies of the source rock.

A competing theory is that the rate-limiting factor for expulsion is the release of petroleum from its source kerogen. This hypothesis places little importance on movement of petroleum within the mineral matrix; rather, it postulates that the expulsion is controlled by adsorption of generated petroleum onto the surface of the kerogen and/or the absorption or diffusion of the hydrocarbons through the kerogen matrix. The concept that kerogen has an absorptive capacity to retain petroleum and only releases hydrocarbon-rich fluids once this capacity is exceeded may facilitate modeling efforts because it requires only knowledge of the kerogen and its petroleum products during basin evolution.

There is considerable evidence that expulsion is governed by the release of petroleum from kerogen. The most direct confirmation is the observation that the amount of extractable petroleum from kerogen isolates is comparable to that extracted from powdered rocks. Other empirical observations supporting this concept include linear correlations between Rock-Eval hydrogen index (HI) and expulsion efficiency and between Rock-Eval S1 and total organic content or TOC that are independent of thermal maturation. Conceptually, differences in generative yield and retention capacity could explain the apparently large differences in expulsion efficiencies between very organic-rich source rocks such as coals and oil shales. Previous efforts to model kerogen retention capacity are largely empirical. A relatively simple rule has been proposed that expulsion occurs when the amount of generated petroleum exceeds 200 mg/g C (+1 mg/g C for the pore space). This approach has been extended to individual hydrocarbon fractions to provide an empirical model of chemical fractionation.

A comprehensive theory of the fundamental principles of the expulsion process is slowly evolving. Early studies explored the concept that bitumen diffuses through the kerogen matrix and molecular diffusion was proposed as a mechanism for expulsion. However, it has been shown than the diffusion effects would preferentially expel fluids with the opposite compositional fractionation as that seen in nature (in other words, aromatics is greater than naphthenes which is greater than alkanes). It has been proposed that kerogen-fluid phase partitioning is more important that diffusivity. An additional proposal is that the compositional fractionation observed in expulsion was consistent with documented interactions between solvents and kerogen. Absorption processes, therefore, may be considered to be an important factor in determining the magnitude and composition of expelled petroleum. While surface adsorption may play some role, solvent-swelling experiments have shown that all types of kerogen have sufficient absorptive properties to explain residual bitumen concentrations in petroleum source rocks and coals. These swelling experiments demonstrated that kerogens and coals behave in manners similar to cross-linked polymer network.

The application of solution theory has been applied to model chemical fractionation during expulsion. In one such application of solution theory, several simplifying assumptions based on limited data have been made. Foremost is the simplification that the kerogen swelling ratio, $Q_v$, exhibits a Gaussian distribution as a function the solvent solubility parameter, $\delta$, with the peak maximum corresponding to the $\delta$ of the kerogen. From this, expulsion efficiency (EEF), defined as proportion of expelled oil to retained bitumen, has been modeled as a function of kerogen generative potential and maximum volumetric swelling ratio, $Q_v$. Using a fixed $Q_v$ value of 1.6 for kerogen, EEFs of 0.9 and 0.7 for a hydrogen-rich and a hydrogen-lean kerogen (HI=538 and 215 mg petroleum/g TOC, respectively) were selected. With the amount of retained and expelled products defined, compositions were calculated for methane and lumped petroleum fractions by comparing their solubility parameters with that of kerogen ($\delta$=19.4 $(J/cm^3)^{1/2}$).

Based on this, it has been concluded that the Hildebrand solution theory predicts the chemical direction, but not the extent of the chemical fractionation observed between natural retained bitumen and expelled oil. In particular, one implementation of the theory predicts that preferential expulsion occurs where saturated hydrocarbons>aromatic hydrocarbons>polar compounds, but the modeled compositions of expelled oil are depleted in saturated hydrocarbons (>30%) and enriched in aromatic hydrocarbons and polar compounds relative to reservoir fluids. It has been suggested that the combination of absorption processes as described by polymer solution theory and adsorption processes that occur within the nanopores of coal macerals accurately predicts the selective expulsion of hydrocarbon gases while retaining larger $C_{15+}$ compounds. Such processes may well occur within coals, but may not be relevant to oil-prone kerogens.

On the other hand, kerogens behave in many ways very similar to synthetic cross-linked polymers. When dealing with the swelling of such polymeric systems, the elastic restoring force of the connected polymer network also must be considered. Polymer science has developed a number of theories of varying complexity to explain this behavior. Conceptually, these theories predict that a highly cross-linked polymer cannot uncoil very much by solvent swelling before the elastic restoring force overcomes the entropy of mixing. As one example, the Flory-Rehner theory of rubber elasticity is comparatively simple and relates the degree of swelling to the average molecular weight between cross-links.

While the composition of the expelled petroleum fluid modeled at 50% fractional conversion is similar to that seen in produced oils, the presence of polar-rich fluids at higher levels of thermal maturation is not consistent with natural occurrences. This is not a flaw in the expulsion model. Rather, it indicates that the composition of the primary products are not fixed, as suggested by open-system laboratory experiments, but changes within the kerogen matrix as a substantial proportion of the evolved polar compounds undergo secondary cracking reactions. By incorporating reaction pathways for the thermal decomposition of polar compounds within a multi-component hydrocarbon generation model, the composition of the non-expelled petroleum fluid can be calculated under geologic heating conditions.

Unfortunately, a complete solution of the expulsion model based on the extended Flory-Rehner and Regular Solution Theory framework is computationally intense and impractical for use within another program that models petroleum generation and secondary cracking. An improved method of modeling basin performance, including predicting petroleum production, is desirable.

SUMMARY OF THE INVENTION

A method for predicting petroleum production is provided. An exemplary embodiment of the method comprises computing a first approximation of an amount of generated petroleum that is retained with a complex organic product using a Threshold and a Maximum Retention value. The exemplary method also comprises revising the first approximation by approximating a process of chemical fractionation using at least one partition factor to create a revised approximation and predicting petroleum production based on the revised approximation.

In an exemplary method for predicting petroleum production, the complex organic product may comprise a kerogen or an asphaltene. The Threshold and the Maximum Retention value describe a degree of swelling corresponding to an amount of bitumen the complex organic product can retain. The Threshold and the Maximum Retention value may be expressed in Hydrogen Index units.

In one exemplary embodiment of the present invention, the first approximation represents the effects of the thermodynamic parameters of cross-link density and native swelling factor. The Threshold and Maximum Retention value may respectively define the minimum and maximum amounts of bitumen that may be retained within the complex organic product as a function of thermal alteration. The Threshold and Maximum Retention value may respectively define a minimum value of generated products below which there is no expulsion and a maximum amount of generated product that may be retained within the complex organic product. The at least one partition factor may reflect a tendency of a chemical lump within the complex organic product to partition or to be expelled.

An exemplary method for producing hydrocarbons from an oil and/or gas field is provided herein. An exemplary embodiment of the method for producing hydrocarbons comprises computing a first approximation of an amount of generated petroleum that is retained with a complex organic product using a Threshold and a Maximum Retention value and revising the first approximation by approximating a process of chemical fractionation using at least one partition factor to create a revised approximation. The exemplary method for producing hydrocarbons may additionally comprise predicting petroleum production based on the revised approximation and extracting hydrocarbons from the oil and/or gas field using the predicted petroleum production.

In an exemplary method for producing hydrocarbons, the complex organic product may comprise a kerogen or an asphaltene. The Threshold and the Maximum Retention value describe a degree of swelling corresponding to an amount of bitumen the complex organic product can retain. At least one of the Threshold and the Maximum Retention values may be expressed in Hydrogen Index units.

In one exemplary embodiment of the present invention, the first approximation may represent the effects of the thermodynamic parameters of cross-link density and native swelling factor. The Threshold and Maximum Retention value may respectively define the minimum and maximum amounts of bitumen that may be retained within the complex organic product as a function of thermal alteration. The Threshold and Maximum Retention value may respectively define a minimum value of generated products below which there is no expulsion and a maximum amount of generated product that may be retained within the complex organic product. The at least one partition factor may reflect a tendency of a chemical lump within the complex organic product to partition or to be expelled.

An exemplary tangible, machine-readable medium is additionally provided herein. The exemplary tangible, machine-readable medium may comprise code adapted to compute a first approximation of an amount of generated petroleum that is retained with a complex organic product using a Threshold and a Maximum Retention value. In addition, the exemplary tangible, machine-readable medium may comprise code adapted to revise the first approximation by approximating a process of chemical fractionation using at least one partition factor to create a revised approximation and code adapted to predict petroleum production based on the revised approximation.

DESCRIPTION OF THE DRAWINGS

The foregoing and other advantages of the present invention may become apparent upon reviewing the following detailed description and drawings of non-limiting examples of embodiments in which.

DETAILED DESCRIPTION OF THE INVENTION

Figure 1:
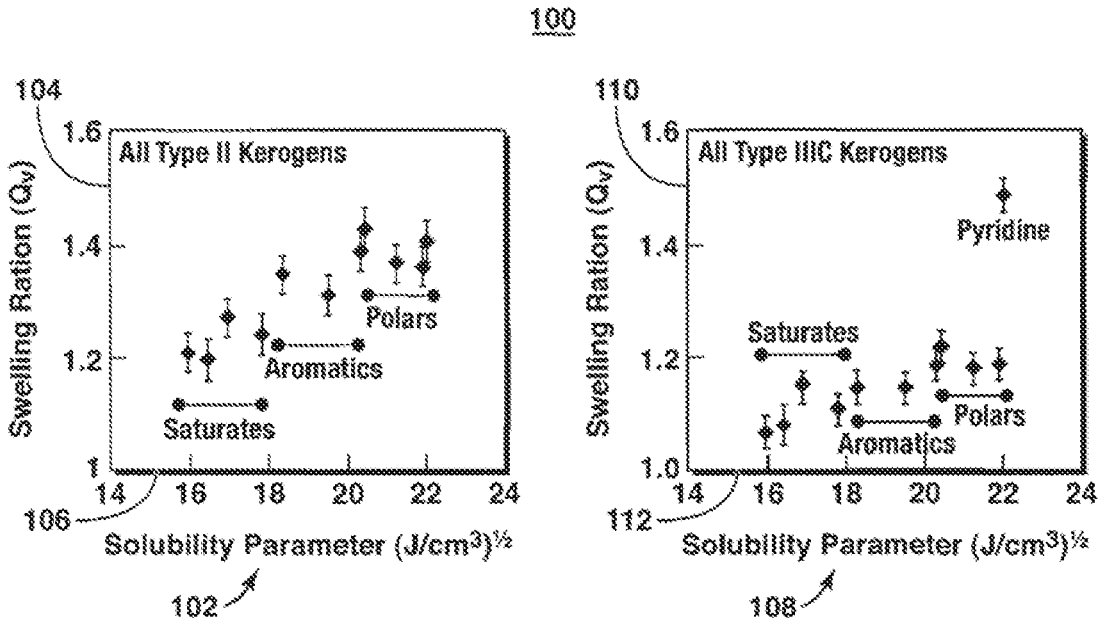
FIG. 1 is a set of graphs showing mean swelling ratios of Type II kerogens and Type IIIC kerogens in different solvents.

In the following detailed description section, the specific embodiments of the present invention are described in connection with preferred embodiments. However, to the extent that the following description is specific to a particular embodiment or a particular use of the present invention, this is intended to be for exemplary purposes only and simply provides a description of the exemplary embodiments. Accordingly, the invention is not limited to the specific embodiments described below, but rather, it includes all alternatives, modifications, and equivalents falling within the true spirit and scope of the appended claims.

At the outset, and for ease of reference, certain terms used in this application and their meanings as used in this context are set forth. To the extent a term used herein is not defined below, it should be given the broadest definition persons in the pertinent art have given that term as reflected in at least one printed publication or issued patent.

As used herein, the term "basin model" refers to a simplification of the earth and its processes with the intent being to track the dynamic evolution of one or more of those processes through time. For example, the processes related to the generation and migration of hydrocarbons is commonly modeled with the intent to determine which of several possible structural culminations may be the most prospective for containing a commercial accumulation. Basin models use data from seismic, well control and knowledge of the geology of the area to construct a numerical model of the region and to track the changes in the various modeled parameters through time to reach a set of predictions that are then calibrated to the known information at the present. The model parameters are then adjusted within geologically reasonable bounds until a successful match and calibration is reached. Prediction can then be made at locations away from the calibration points.

As used herein, the term "fractionation" refers to separation of a substance into components governed by physical and/or chemical processes, for example, by distillation or crystallization.

As used herein, the term "kerogen" refers to a solid, carbonaceous material. When kerogen is imbedded in rock formations, the mixture is referred to as oil shale. This is true whether or not the mineral is, in fact, technically shale, that is, a rock formed from compacted clay. Kerogen is subject to decomposing upon exposure to heat over a period of time. Upon heating, kerogen molecularly decomposes to produce oil, gas, and carbonaceous coke. Small amounts of water may also be generated. The oil, gas and water fluids are mobile within the rock matrix, while the carbonaceous coke remains essentially immobile.

Kerogen may be classified into four distinct groups: Type I, Type II, Type III, and Type IV. Kerogen types used herein are as defined in Tissot and Welte (Tissot, B. P. and Welte, D. H., Petroleum Formation and Occurrence, second edition, Springer-Verlag, Berlin, 1984, p. 151). The maturation sequence for kerogen that typically occurs over geological time is due to burial leading to exposure to increased temperature and pressure. Classification of kerogen type may depend upon precursor materials of the kerogen. The precursor materials transform over time into macerals or amorphous masses. Macerals are microscopic structures that have distinguishing morphologies, different chemical structures and properties depending on the precursor materials from which they are derived. Amorphous kerogens have no distinguishing morphological features that can be used to characterize its precursor materials, but may have different chemical structures and properties.

Type I and II kerogens primarily contain amorphous organic matter and lipinite macerals. These oil-prone macerals that have low reflectance, high transmittance, and intense fluorescence at low levels of maturity. Many liptinite phytoclasts have characteristic shapes and textures, e.g., algae (such as Tasmanites), resin (impregnating voids), or spores. Liptinites are broadly divided into alginites and exinites. Type I kerogens are frequently deposited in lacustrine environments while Type II kerogen may develop from organic matter that was deposited in marine environments. Oil shale may be described as sedimentary rocks containing abundant Type I or Type II kerogen. It may contain primarily contain macerals from the liptinite group or be amorphous. The concentration of hydrogen within liptinite may be as high as 9 weight %. In addition, liptinite has a relatively high hydrogen to carbon ratio and a relatively low atomic oxygen to carbon ratio.

Under certain depositional conditions that favor the generation of $H_2S$ in the water column of upper sediments, the precursor organic matter may incorporate large amounts of sulfur as organo-sulfur species (e.g., sulfidic and aromatic-sulfur forms). This high sulfur kerogens are termed Types IS and IIS.

Type III kerogens are derived from organic matter derived from land plants that are deposited in lakes, swamps, deltas and offshore marine settings. Type III kerogen may be subdivided into Type IIIV, which are primarily made up of vitrinite macerals, and Type IIIC, which are mostly amorphous and derived from more hydrogen-rich cutins and waxes. Vitrinite is derived from cell walls and/or woody tissues (e.g., stems, branches, leaves, and roots of plants). Type III kerogen is present in most humic coals. Under certain depositional settings, Type IIIC kerogens may incorporate sulfur, resulting in a sulfur rich form termed Type IIICS.

Type IV kerogen includes the inertinite maceral group. The inertinite maceral group is composed of plant material such as leaves, bark, and stems that have undergone oxidation during the early peat stages of burial diagenesis, charcoals or black carbon, and amorphous kerogens that were oxidized during deposition or during erosion and transport. Inertinite maceral is chemically similar to vitrinite, but has a high carbon and low hydrogen content.

As kerogen undergoes maturation, the composition of the kerogen changes as chemical bonds are broken and new one form. During this process, mobile fluids that include gases (e.g. methane, light hydrocarbons, $CO_2$, and $H_2S$), petroleum, and water are expelled from the kerogen matrix, enter the pores of the rock matrix and may migrate from the source rock into more porous reservoir rocks. The level of thermal alteration that a kerogen is exposed to may be characterized by a number of physical and chemical properties. These include, but not limited to, vitrinite reflectance, coloration of spores or fossils, elemental compositions (e.g., H/C, N/C, or S/C atomic ratios), chemical speciation (e.g., % aromaticity, sulfidic/thiophenic sulfur), molecular compositions (e.g., various biomarker ratios), and stable isotopic ratios of bulk fractions or individual compounds.

As used herein, the term "Maximum Retention" refers to a maximum amount of bitumen that may be retained within a kerogen as a function of thermal alteration.

As used herein, the terms "partition factor" and "preference factor" refer to a measure that reflects a tendency of a particular chemical lump to partition within a kerogen or to be expelled.

As used herein, "NSO" or "NSOs" refers to nitrogen, sulfur, and oxygen containing compounds.

As used herein, "tangible machine-readable medium" refers to a medium that participates in directly or indirectly providing signals, instructions and/or data to a processing system. A machine-readable medium may take forms, including, but not limited to, non-volatile media (e.g., ROM, disk) and volatile media (RAM). Common forms of a machine-readable medium include, but are not limited to, a floppy disk, a flexible disk, a hard disk, a magnetic tape, other magnetic medium, a CD-ROM, other optical medium, punch cards, paper tape, other physical medium with patterns of holes, a RAM, a ROM, an EPROM, a FLASH-EPROM, or other memory chip or card, a memory stick, and other media from which a computer, a processor or other electronic device can read.

As used herein, the term "Threshold" refers to a minimum amount of bitumen that may be retained within a kerogen as a function of thermal alteration.

Some portions of the detailed descriptions which follow are presented in terms of procedures, steps, logic blocks, processing and other symbolic representations of operations on data bits within a computer memory. These descriptions and representations are the means used by those skilled in the data processing arts to most effectively convey the substance of their work to others skilled in the art. In the present application, a procedure, step, logic block, process, or the like, is conceived to be a self-consistent sequence of steps or instructions leading to a desired result. The steps are those requiring physical manipulations of physical quantities. Usually, although not necessarily, these quantities take the form of electrical or magnetic signals capable of being stored, transferred, combined, compared, and otherwise manipulated in a computer system.

It should be borne in mind, however, that all of these and similar terms are to be associated with the appropriate physical quantities and are merely convenient labels applied to these quantities. Unless specifically stated otherwise as apparent from the following discussions, it is appreciated that throughout the present application, discussions utilizing the terms such as "processing", "computing", "revising", "predicting" or the like, refer to the action and processes of a computer system, or similar electronic computing device, that transforms data represented as physical (electronic) quantities within the computer system's registers and memories into other data similarly represented as physical quantities within the computer system memories or registers or other such information storage, transmission or display devices. Example methods may be better appreciated with reference to flow diagrams.

While for purposes of simplicity of explanation, the illustrated methodologies are shown and described as a series of blocks, it is to be appreciated that the methodologies are not limited by the order of the blocks, as some blocks can occur in different orders and/or concurrently with other blocks from that shown and described. Moreover, less than all the illustrated blocks may be required to implement an example methodology. Blocks may be combined or separated into multiple components. Furthermore, additional and/or alternative methodologies can employ additional, not illustrated blocks. While the figures illustrate various actions occurring in serial, it is to be appreciated that various actions could occur concurrently, substantially in parallel, and/or at substantially different points in time.

An exemplary embodiment of the present invention relates to a method in which the thermodynamic model of expulsion may be expressed within a program that models petroleum generation and secondary cracking. This program is referred to herein as a Chemical Structure-Chemical Yields Model (CS-CYM). One example of a CS-CYM is generally described in U.S. Pat. No. 7,344,889, entitled "Chemical Structural and Compositional Yields Model for Predicting Hydrocarbon Thermolysis Products", which issued to Kelemen, et al. on Mar. 18, 2008.

In one exemplary embodiment of the present invention, a theoretical model couples Regular Solution Theory with an extended version of the Flory-Rehner Theory of Rubber Elasticity to more accurately describe the swelling behavior of kerogen by different solvents and solvent mixtures. Average thermodynamic parameters (solubility parameter, cross-link density and native swelling, for example) for Type II (hydrogen-rich marine) and Type IIIC (hydrogen-rich terrigenous) kerogens were determined from solvent swelling experiments and then used to model the equilibrium between these kerogens and multiple mixtures of pure compounds that served as surrogates for petroleum chemical groupings. The modeled compositions of expelled petroleum were found to be comparable to that seen in produced fluids. Set forth below are a summary of the results and predictions made for the composition of expelled petroleum and retained bitumen when the expulsion model is coupled with thermal maturation of kerogen under geologic conditions. According to an exemplary embodiment of the present invention, kerogen retention and selective solubility are believed to be major processes that govern petroleum expulsion and chemical fractionation.

In a theoretic framework according to an exemplary embodiment of the present invention, each solvent component, i, is characterized by its molar volume $\nu_i$ and its solubility parameter $\delta_i$, whereas the kerogen network is characterized by its solubility parameter $\delta_0$, cross-linking density $\eta$ (moles per volume), and native swelling volume fraction $\nu_{eq}$. In Regular Solution Theory, the solubility parameter of a pure substance is defined nominally to be the square-root of its cohesive energy per volume, and the effective molar volume and solubility parameter of a mixture such substances are obtained by volume-averaging. The cross-linking density and native swelling volume fraction determine the elastic (osmotic) pressure exerted on the solvent molecules by the kerogen network swollen to a volume fraction $\nu_o$:

$$\Pi_{el}=RT\eta(\nu_o^{1/3}\nu_{eq}^{2/3}-\nu_0) \quad (1)$$

In the above equation, $\nu_{eq}$ represents the amount of swelling for which there is no exerted elastic pressure, accounting for the possibility that cross-linking might have occurred in the presence of absorbed material.

When an initially single-phase solvent mixture is exposed to kerogen, each solvent component i is preferentially absorbed into the kerogen network, and a two-phase equilibrium is established between the surrounding solvent mixture (liq) and the kerogen-absorbed solvent mixture (abs) system. The kerogen-(abs) phase is treated as a regular mixture of the kerogen network and (abs), which takes into account the elastic energy of the swollen kerogen network. If $\{x_i, y_i\}$ denote molar fractions of solvent component i in (liq) and (abs) respectively, phase equilibrium between (liq) and kerogen-(abs) is achieved when, $$\ln x_i+\ln(\nu_i/\nu_{liq}+\nu_i b_{i,liq}=\ln y_i \ln(\nu/\nu_{abs})+\ln(1-\nu_o)-(1-\nu_o)\nu_i/\nu_{abs}+\nu_i b_{i,k-abs}+\nu_i\Pi_{el}/RT, \quad (2)$$

where $\nu_i$ is the molar volume of solvent i.

The interaction parameters between the two phases and component i are given by Regular Solution Theory:

$$b_{i,liq}=(\delta_i-\delta_{liq})^2/RT \quad (3)$$

$$b_{i,k-abs}=(\delta_i-[(1-\nu_o)\delta_{abs}+\nu_o\delta_o])^2/RT \quad (4)$$

If the composition of (liq) $\{x_i\}$ is known, the composition $\{y_i\}$ of (abs) and the volumetric swelling $1/\nu_0$ of the kerogen can be computed by simultaneously solving the equations of phase equilibrium.

A model according to an exemplary embodiment of the present invention requires only the solubility parameter $\delta_i$ and molar volume $\nu_i$ of each of the liquid components, and the solubility parameter $\delta_0$, cross-linking density $\eta$ (moles per volume), and native swelling volume fraction $\nu_{eq}$ of the kerogen to predict the degree of kerogen swelling and the composition of the retained and expelled fluids in equilibrium. The solubility parameter ($\delta_0$) is a numerical value that indicates the relative solvency behavior of a specific solvent. The cross-link density ($\eta$) of the network of organic matter of kerogen reflects the sum of all bond-breaking and bond-making reactions that have taken place during maturation. Native swelling is the volume fraction ($\nu_{eq}$) of the solvent-swollen kerogen when it is on average stress-free. Since $\delta_i$ and $\nu_i$ are known or readily calculated for pure compounds, only the thermodynamic parameters $\delta_0$, $\eta$, and $\nu_{eq}$ for kerogen need to be determined experimentally.

Below is an explanation of an experimental determination of kerogen thermodynamic parameters in accordance with an exemplary embodiment of the present invention. Polymer scientists have studied the swelling behavior of polymers in solvents to characterize the physical network structure and chemical nature of these synthetic materials One example is set forth in the following article: Ertas, D., Kelemen, S. R., Halsey, T. C., 2006. Petroleum Expulsion Part 1. Theory of Kerogen Swelling in Multi-Component Solvents. Energy & Fuels 20, 295-300. Coals were the first "geopolymers" to be studied by this technique. Type I and Type II kerogens were subsequently examined. The swelling behavior of the oil prone kerogens has been found to follow the pattern anticipated by Regular Solution Theory. Unlike coals, hydrogen bonding appears not to play a major role in intermolecular bonding in the network. Moreover, the kerogen behaves as if it has a high cross-link density. Swelling generally decreases with increasing kerogen maturity.

An extended Flory-Rehner and Regular Solution Theory framework in accordance with an exemplary embodiment of the present invention defines swelling behavior of a kerogen by its solubility parameter $\delta_0$, cross-linking density $\eta$ (moles per volume), and native swelling volume fraction $\nu_{eq}$. These parameters cannot be independently measured, but can be discovered experimentally. To determine the value of these parameters, a series of kerogen solvent swelling experiments has been conducted. Briefly, after weighed kerogen samples placed into ~3 cm long NMR tubes (5 mm) are centrifuged, their initial dry sample height is recorded. A solvent is added, stirred, topped with a plug of glass wool, and placed in an upright position within a 100 mL Parr high-pressure reactor vessel, which holds up to twenty-eight sample tubes at one time, and covered with excess solvent. Table 1 lists the solvents used in the swelling experiments. The reactor is sealed, evacuated, and pressurized with helium (100 kPa) and heated to 30° C., 90° C. or 150° C. for 24 hours. After cooling, each tube is centrifuged before recording the final height for each tube. Solvents used in kerogen swelling experiments are set forth in Table 1:

TABLE 1

Solvents used in kerogen swelling experiments.

| | Solvent | $\delta$, $(J/cm^3)^{1/2}$ | Molar Vol. $cm^3$ |
|---|---|---|---|
| Sat. | n-decane | 15.8 | 195.9 |
| | n-hexadecane | 16.3 | 294.1 |
| | cyclohexane | 16.8 | 108.7 |
| | decalin | 17.7 | 154.2 |

TABLE 1-continued

Solvents used in kerogen swelling experiments.

| | Solvent | δ, $(J/cm^3)^{1/2}$ | Molar Vol. $cm^3$ |
|---|---|---|---|
| Aro. | toluene | 18.2 | 106.9 |
| | tetralin | 19.4 | 136.3 |
| | 1-methylnaphthalene | 20.2 | 139.4 |
| Polars | 2,5-dimethylpyrrole | 20.3 | 101.7 |
| | benzofuran | 21.1 | 108.3 |
| | benzothiophene | 21.8 | 124.7 |
| | pyridine | 21.9 | 80.6 |

The ratio of the final volume of kerogen to the initial volume of kerogen is defined as the volumetric swelling ratio $Q_v$ (Table 2). Measured volumetric swelling ratios ($Q_v$) of kerogens are set forth below in Table 2:

TABLE 2

Measured volumeric swelling ratios ($Q_v$) of kerogens.

| ID | Type | Tmax, ° C. | HI | Mean Qv | ANOVA ± 95% | N |
|---|---|---|---|---|---|---|
| A-1 | II | 438 | 401 | 1.435 | 0.017 | 48 |
| B-1 | II | 425 | 581 | 1.422 | 0.018 | 64 |
| C-1 | II | 413 | 577 | 1.435 | 0.017 | 50 |
| D-1 | II | 414 | 532 | 1.317 | 0.017 | 64 |
| D-2 | II | 438 | 439 | 1.376 | 0.022 | 33 |
| D-3 | II | 443 | 242 | 1.307 | 0.022 | 33 |
| D-4 | II | 479 ↓ | 22 | 1.161 | 0.022 | 33 |
| F-1 | IIIC | 424 | 237 | 1.349 | 0.017 | 53 |
| G-1 | IIIC | 411 | 251 | 1.365 | 0.017 | 53 |
| H-1 | IIIC | 427 | 295 | 1.210 | 0.023 | 32 |
| H-2 | IIIC | 453 | 235 | 1.073 | 0.023 | 32 |
| H-3 | IIIC | 479 ↓ | 120 | 1.061 | 0.022 | 32 |
| I-1 | IIS | 411 | 611 | 1.182 | 0.024 | 28 |
| J-1 | I | 446 | 739 | 1.620 | 0.023 | 32 |
| K-1 | I | 444 | 995 | 1.296 | 0.025 | 27 |

Kerogen Types:
II = Oil prone marine,
IIIC = Oil prone terrigenous,
IIIV = Gas prone terrigenous,
IIS = Oil prone, sulfer-rich.
I = Oil prone lacustrine.
↓ = Maturity sequence
$Q_v$ = Volumetric swelling ratio
N = number of analyses
ANOVA = analysis of variance With $Q_v$ determined for kerogens in solvents with known solubility parameter and molar volume, the kerogen thermodynamic properties $\delta_0$, η, and $\nu_{eq}$ are chosen such that the mean square error between theory and experiment is minimized. Although the values may be determined for an individual kerogen, a more robust solution has been determined by summing the data for all Type II (oil-prone, marine) and Type IIIC (oil-prone, terrigenous) kerogens.

FIG. 1 is a set of graphs showing mean swelling ratios of Type II kerogens and Type IIIC kerogens. The set of graphs is generally referred to by the reference number 100. The set of graphs 100 comprises a left-hand graph 102 that shows a y-axis 104 and an x-axis 106. The left-hand graph 102 represents data for all Type II kerogens. The y-axis 104 represents a swelling ratio $Q_v$ and the x-axis 106 represents a solubility parameter in $(J/cm^3)^{1/2}$. The set of graphs 100 also comprises a right-hand graph 108 that shows a y-axis 110 and an x-axis 112. The right-hand graph 108 represents data for all Type IIIC kerogens. The y-axis 110 represents a swelling ratio $Q_v$ and the x-axis represents a solubility parameter in $(J/cm^3)^{1/2}$.

As shown in FIG. 1, statistically significant differences in the mean swelling ratios Qv are found between solvents with varying solubility parameters and molar volumes (Table 1) and the summed data sets of Type II and IIIC kerogens. A simple bell-shaped curve to determine the δ of kerogen will not capture these variations. Note that pyridine exerts a specific interaction with the Type IIIC kerogens (but not the Type II) and pyridine data are excluded in the analysis for Type IIIC kerogens.

Values for the thermodynamic parameters that minimize the error across the combined data sets are listed below in Table 3:

TABLE 3

Best fit values for kerogen thermodynamic parameters.

| Kerogen (average) | Type II | Type IIIC* |
|---|---|---|
| Solubility Parameters, δ $(J/cm^3)^{1/2}$ | 22.5 | 23.3 |
| Cross-link density, η $mol/cm^3$ | 0.16 | 0.25 |
| Native Swelling Fraction | 0.76 | 0.85 |
| Correlation Index, $R^2$ | 0.923 | 0.962 |

*Excludes pyridine.

Figure 2:
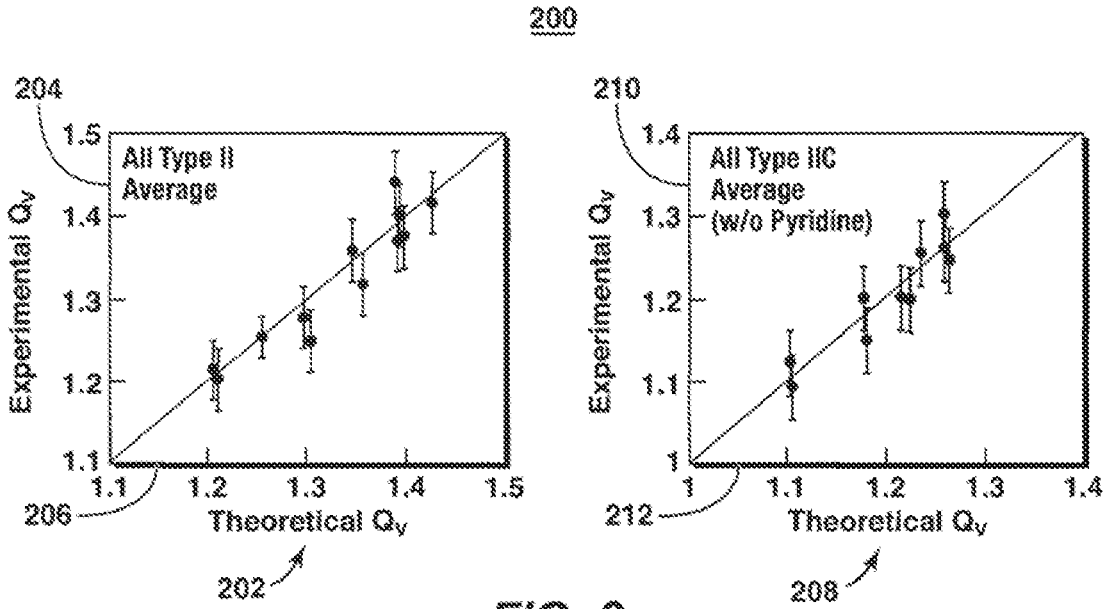
FIG. 2 is a set of graphs showing a comparison of experimental results and predicting swelling for average Type II kerogens and Type IIIC kerogens in different solvents.

FIG. 2 is a set of graphs showing a comparison of experimental results and predicting swelling for average Type II kerogens and Type IIIC kerogens in different solvents. The set of graphs is generally referred to by the reference number 200. The set of graphs 200 comprises a left-hand graph 202 that shows a y-axis 204 and an x-axis 206. The left-hand graph 202 represents average data for all Type II kerogens. The y-axis 204 represents an experimental swelling ratio $Q_v$ and the x-axis 206 represents a theoretical or predicted swelling ratio $Q_v$. The set of graphs 200 also comprises a right-hand graph 208 that shows a y-axis 210 and an x-axis 212. The right-hand graph 208 represents average data for all Type IIIC kerogens. The y-axis 210 represents an experimental swelling ratio $Q_v$ and the x-axis 212 represents a theoretical or predicted selling ratio $Q_v$. As shown in FIG. 2, the swelling behavior of kerogens in the solvents predicted by a theory in accordance with an exemplary embodiment of the present invention using these parameter values agrees with the experimental observations within analytical error.

A general expulsion model desirably considers the chemical changes that occur in kerogen as it thermally matures. The maximum swelling response for genetically related Type II kerogens remains relatively constant through much of the oil window, then decreases during the more advanced stages of maturation (Table 2, Samples D1-D4). The Type IIIC samples swell less than the Type II samples at comparable $T_{max}$ temperature, but qualitatively exhibit the same decrease in maximum $Q_v$ with increasing $T_{max}$ (Table 2, Samples H1-H3). Similar swelling behavior has been observed in a maturation suite of Type I kerogens from the Green River Formation, though the maximum $Q_v$ for these samples are two to three times greater than those found for Type II and IIIC kerogens.

The observation that the maximum swelling response does not change appreciably in genetically related Type II and IIIC kerogens during catagenesis implies that their solubility parameter does not vary even though the chemistry of the kerogen is changing. The apparent constancy of solubility parameter (δ) values may be attributed to offsetting chemical reactions that occur during petroleum generation. The simultaneous loss of oxygen functionalities with the increase in aromatization counterbalance, such that δ values for Type II and IIIC kerogens increase only after they have expended a significant portion of their generative potential. These experimental observations are consistent with a theoretical model of kerogen structure and reactivity in accordance with an exemplary embodiment of the present invention.

The small changes in swelling behavior observed to occur in immature to mature Type II and IIIC kerogens permits the use of a single model for expulsion and chemical fractionation at ≦75% conversion. A second model is used to reflect changes in kerogen solubility parameters and cross-link density at higher levels of thermal maturity.

The following discussion relates to the modelling of petroleum expulsion and chemical fractionation. With the thermodynamic parameters determined for Type II and IIIC kerogens, the amount and composition of retained or expelled petroleum can be determined. In theory, these calculations could be expressed on very complex mixtures of molecules that are close approximations of the actual compositions of kerogen thermal decomposition fluids. In practice, computational limitations restrict calculations to about forty unique molecular components. Several suites of specific molecules were constructed and the expulsion behavior of these mixtures has been modeled. The molar volume and solubility parameter of these compounds either have been measured or can be calculated to a higher accuracy than an estimated average value for a hydrocarbon compositional lump (see FIG. 3). As such, these compounds act as surrogates for a much larger number of molecules that comprise oil and bitumen that when combined can be used to predict the expulsion and chemical fractionation behavior of all major petroleum compound classes.

Figure 3:
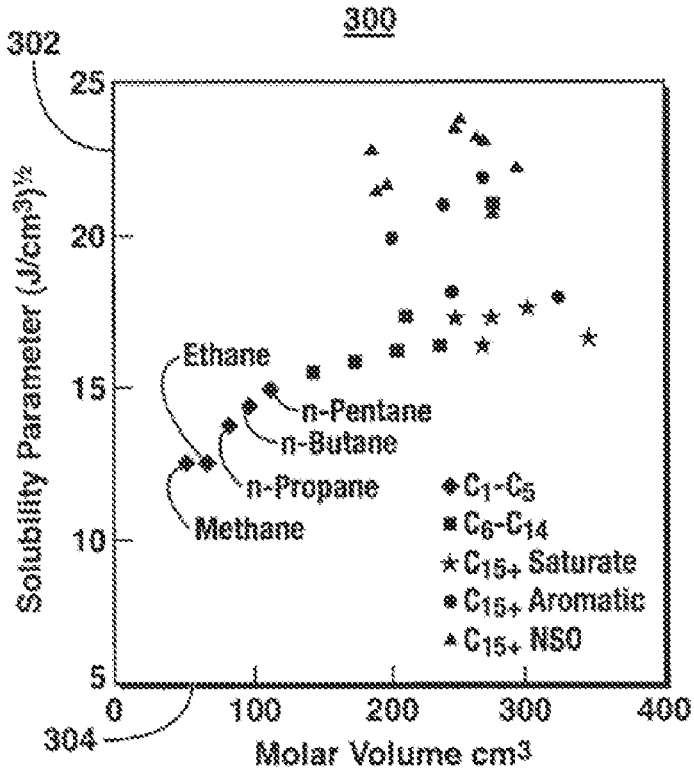
FIG. 3 is a graph showing a range of solubility parameters and molar volumes of a forty molecular-component mixture used as a surrogate for modeling petroleum in accordance with an exemplary embodiment of the present invention.

FIG. 3 is a graph showing a range of solubility parameters and molar volumes of a forty-component mixture used as a surrogate for modeling petroleum in accordance with an exemplary embodiment of the present invention. The graph is generally referred to by the reference number 300. The graph 300 has a y-axis 302 that corresponds to a solubility parameter in $(J/cm^3)^{1/2}$. An x-axis 304 corresponds to molar volume in $cm^3$.

Starting with the primary, non-fractionated petroleum fluids generated from Type II and IIIC kerogens, the compositions of the retained bitumen and expelled oils can be modeled. The primary fluids are described from laboratory experiments in terms of hydrocarbon lumps (for example, $C_1$ through $C_5$, $C_{10}$-$C_{14}$, $C_{15+}$ saturates, $C_{15+}$ aromatics, $C_{15+}$ polars) that can be modeled from the representative surrogate mixtures. The predicted compositions of expelled fluids correspond well with the compositional range observed for produced petroleum (see FIG. 4). The predicted bitumen (kerogen-retained, soluble organic matter) compositions are uniformly >50% $C_{15+}$ NSOs at all levels of maturity for all modeled kerogens.

Figure 4:
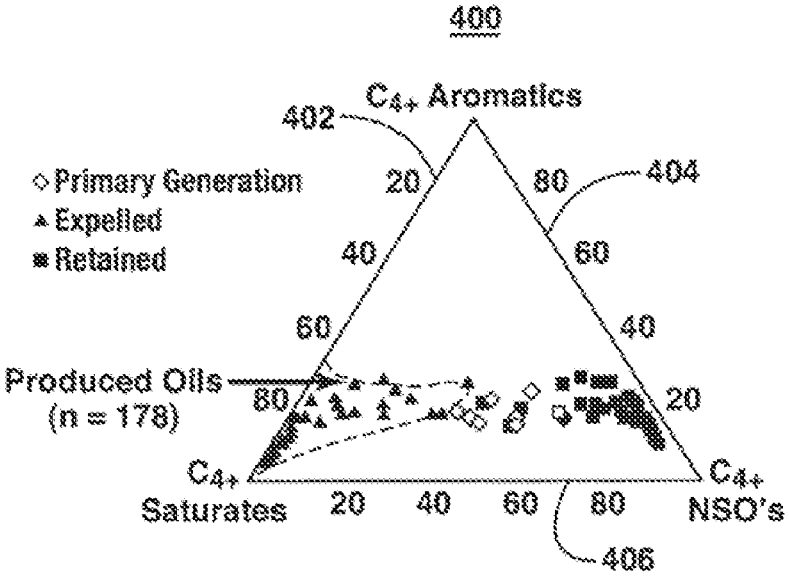
FIG. 4 is a graph showing a predicted composition of expelled and retained petroleum in accordance with an exemplary embodiment of the present invention.

FIG. 4 is a graph showing a predicted composition of expelled and retained petroleum in accordance with an exemplary embodiment of the present invention. The graph is generally referred to by the reference number 400. The graph 400 shows primary generation, expelled petroleum and retained petroleum. The graph 400 shows a first axis 402 that represents total NSO compounds in units of normalized weight %. A second axis 404 represents total aromatic hydrocarbons in units of normalized weight %. A third axis 406 represents $C_{4+}$ saturated hydrocarbons in units of normalized weight %.

The influence of individual parameters on expulsion can be tested by modeling various combinations of primary fluid composition and kerogen richness, solubility, and swelling behavior. In general, the amount and composition of expelled products are most sensitive to the generative potential and cross-link density of the kerogen. That is, kerogen with lower source richness (hydrocarbon generative potential) and cross-link density is associated with bitumen retention and a relative enrichment of the aliphatic components in the expelled petroleum. Higher source richness and cross-link density results in earlier expulsion of fluids that are enriched in polar components. Differences in the solubility parameter of the kerogen and the composition of the primary fluids exert less influence on chemical fractionation.

Figure 5:
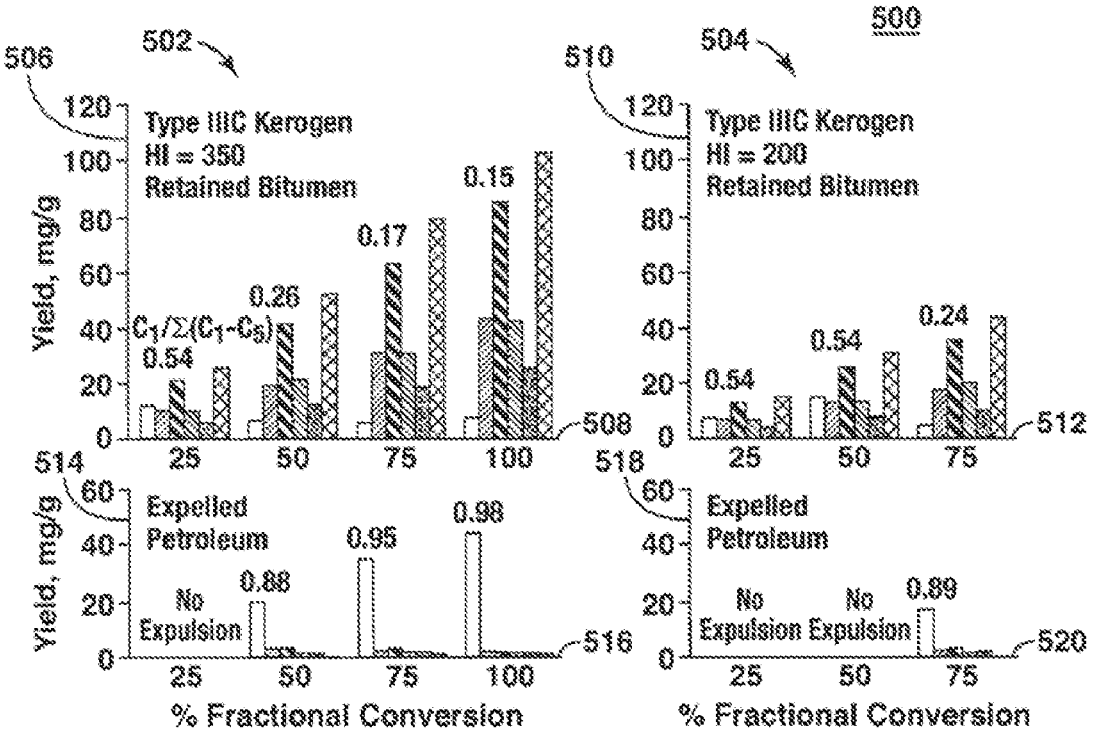
FIG. 5 is a set of graphs showing the influence of organic richness on the onset and extent of petroleum expulsion in accordance with an exemplary embodiment of the present invention.

FIG. 5 is a set of graphs showing the influence of organic richness on the onset and extent of petroleum expulsion in accordance with an exemplary embodiment of the present invention. The set of graphs is generally referred to by the reference number 500. The set of graphs 500 includes a left panel 502 and a right panel 504. The left panel 502 shows petroleum yield for Type IIIC kerogens at an HI value of 350. The left panel 502 includes an upper graph having a y-axis 506 that represents yield in units of mg/g. An x-axis 508 of the upper graph of the left panel 502 represents a percentage of fractional conversion. A lower graph of the left panel 502 includes a y-axis 514 that represents yield in units of mg/g. The lower graph of the left panel 502 also includes an x-axis 516 that represents a percentage of fractional conversion. The right panel 504 shows petroleum yield for Type IIIC kerogens at a Hydrogen Index value of 200. The right panel 504 includes an upper graph having a y-axis 510 that represents yield in units of mg/g. An x-axis 512 of the upper graph of the right panel 504 represents a percentage of fractional conversion. A lower graph of the right panel 504 includes a y-axis 518 that represents yield in units of mg/g. The lower graph of the right panel 504 also includes an x-axis 520 that represents a percentage of fractional conversion.

The extended Flory-Rehner and Regular Solution Theory framework explains many of the empirical observations made on the expulsion phenomena. Empirical observations for the dependency of expulsion on organic richness and the apparent need for a saturation threshold are accurately modeled. For example, calculations for Type IIIC kerogens that differ only in their hydrogen index indicate that ~150 mg/g of primary product must be generated before a convergent solution is obtained for an expelled product, as shown in FIG. 5. The non-convergence may be interpreted to indicate that expulsion does not occur. The composition of the expelled petroleum is highly enriched in methane and light saturated hydrocarbons while most of the polar compounds are retained in the bitumen. The gas dryness of the expelled petroleum increases with increasing fractional conversion while the retained bitumen is comparatively highly enriched in wet gas hydrocarbons.

The influence of organic richness on the onset and extent of petroleum expulsion is captured by the extended Flory-Rehner and Regular Solution Theory framework. The two modeled kerogens possess identical thermodynamic values for $\delta$ (22.6 $(J/cm^3)^{1/}$), $\eta$ (0.16 $mol/cm^3$) and $\nu_0$ (0.83) and differ only in their initial HI. The composition of the primary generated products is held fixed at all levels of fractional conversion. Gas dryness $C_1/\Sigma(C_1\text{-}C_5)$ values for the expelled and retained petroleum are shown.

A theory in accordance with an exemplary embodiment of the present invention also accounts for observations involving the expulsion of polar-rich from low maturity sulfur-rich kerogens (Type IIS). Experiments conducted on a sample from the Monterey Formation shows that this Type IIS kerogen swells significantly less than that of Type II kerogen at equivalent maturity. A solubility parameter for this kerogen is calculated at ~23.5 $(J/cm^3)^{1/2}$ using the chemical structural model and group additivity theory specified in CS-CYM. The remaining thermodynamic parameters derived from single sample analysis indicate that Type IIS kerogen has a much higher cross-link density than a low-sulfur Type II kerogen. Modeling of the expulsion behavior of Type II and Type IIS kerogens with the same hydrogen index (600 mg/g $C_{org}$) after 25% fractional conversion yields very different results.

Figure 6:
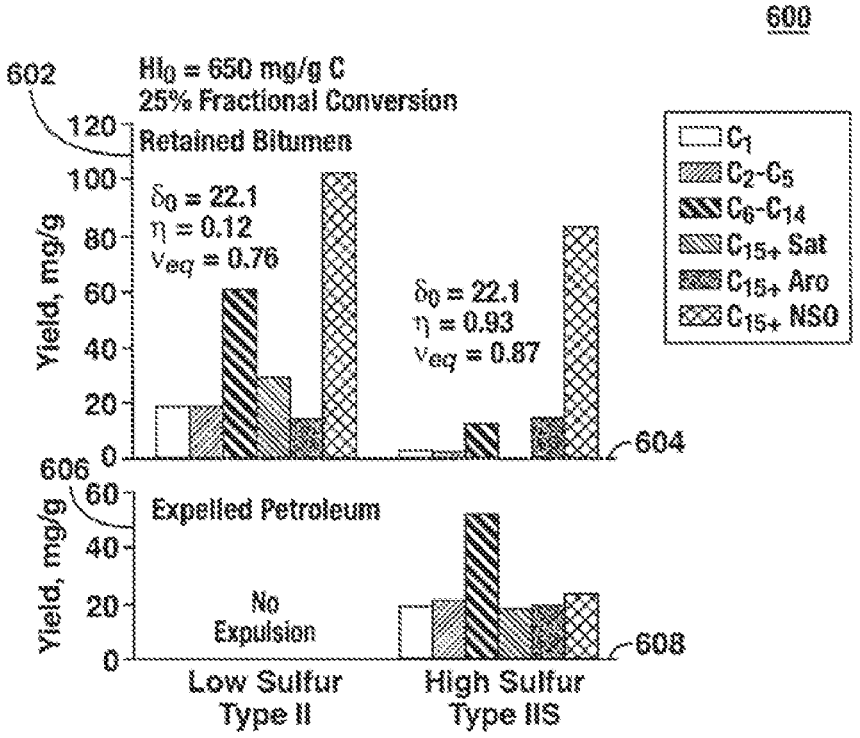
FIG. 6 is a set of graphs showing a comparison of the compositions and yields of retained bitumen and expelled petroleum for a low-sulfur Type II kerogen and a high-sulfur Type IIS kerogen in accordance with an exemplary embodiment of the present invention.

FIG. 6 is a set of graphs showing a comparison of the compositions and yields of retained bitumen and expelled petroleum for a low-sulfur Type II kerogen and a high-sulfur Type IIS kerogen in accordance with an exemplary embodiment of the present invention. The set of graphs is generally referred to by the reference number 600. The set of graphs 600 includes an upper graph having a y-axis 602 that represents retained bitumen yield in units of mg bitumen/g total organic carbon. An x-axis 604 of the upper graph represents bitumen fraction components for low sulfur Type II and high sulfur Type IIS kerogens. A lower graph of the set of graphs 600 includes a y-axis 606 that represents the yield of expelled bitumen in units of mg expelled petroleum/g total organic carbon An x-axis 608 of the lower graph represents expelled petroleum fractions for low sulfur Type II and high sulfur Type IIS kerogens.

While swelling capacity of the low-sulfur kerogen is sufficient such that no expulsion occurs (non-convergence), the swelling capacity of the high-sulfur kerogen is exceeded forcing expulsion of primary generated product. The chemical fractionation still preferentially expels saturated hydrocarbons to the point that few saturated species remain. However, the mass balance requires that aromatic hydrocarbon and polar compounds also be excluded from the kerogen matrix such that over half of the $C_{15+}$ composition of the expelled petroleum is composed of polar compounds.

In FIG. 6, both kerogens have the same initial generative potential and are at the same level of fractional conversion at 25%. The maximum swelling ratio of the Type IIS kerogen is appreciably less than that of the Type II kerogen and is reflected mostly in the cross-link density. The lower retention capacity of the Type IIS kerogen results in the expulsion of the early-generated NSO compounds. In contrast, the Type II kerogen is capable of retaining all generated fluids at this level of conversion.

As demonstrated by decreasing maximum $Q_v$ for the Type II and Type IIIC kerogens, the capacity to retain bitumen decreases with increasing thermal stress (see Table 2). Hence, a larger proportion of the primary products are expelled as kerogen matures. The solubility parameter of the kerogen also increases at higher levels of maturation resulting in diminished chemical fractionation between non-polar hydrocarbons and polar NSO compounds. The combined effects of thermal maturation are illustrated in FIG. 7.

Figure 7:
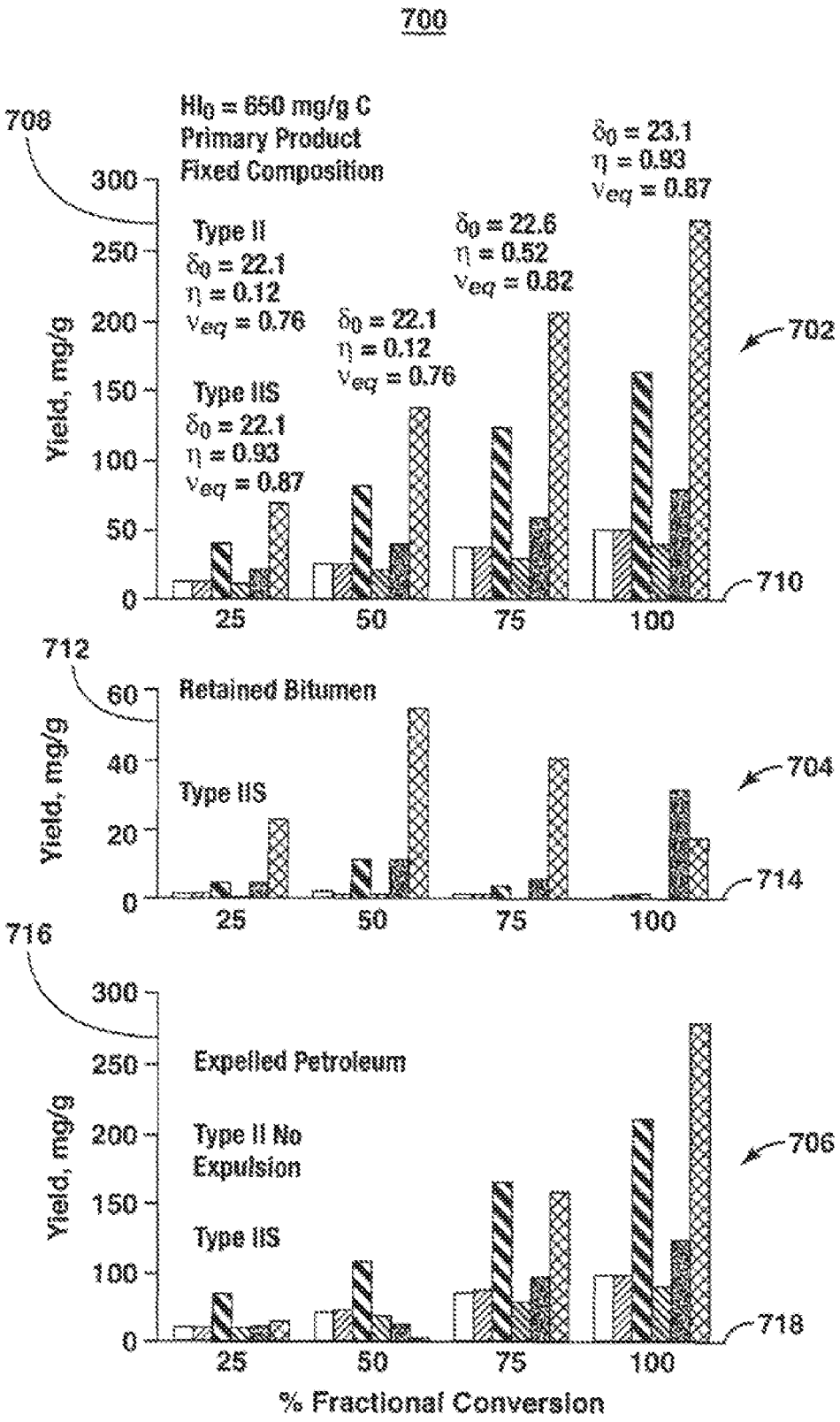
FIG. 7 is a set of graphs showing a comparison of the compositions and yields of retained bitumen and expelled petroleum for an oil-prone kerogen at increasing levels of thermal stress in accordance with an exemplary embodiment of the present invention.

FIG. 7 is a set of graphs showing a comparison of the compositions and yields of retained bitumen and expelled petroleum for an oil-prone kerogen at increasing levels of thermal stress in accordance with an exemplary embodiment of the present invention. The set of graphs is generally referred to by the reference number 700. The set of graphs includes a first panel 702, a second panel 704 and a third panel 706. The first panel 702 includes a y-axis 708 that represents yield in mg/g. An x-axis 710 of the first panel 702 represents a percentage of fractional conversion. The second panel 704 includes a y-axis 712 that represents yield in mg/g. An x-axis 714 of the second panel 704 represents a percentage of fractional conversion. The third panel 706 includes a y-axis 716 that represents yield in mg/g. An x-axis 718 of the third panel 706 represents a percentage of fractional conversion.

The composition of the primary products is held constant. Values for the thermodynamic parameters are shown. At 25% fractional conversion, no expulsion occurs using the values for Type II kerogen, but does so for the more cross-linked Type IIS. At higher levels of thermal stress, both Type II and IIS kerogens are expected to behave in a similar fashion.

As discussed above, using the thermodynamic values determined for low-sulfur Type II kerogen, no expulsion occurs at 25%. The lower retention capacity of the Type IIS kerogen expels a polar-rich fluid. Both Type II and IIS kerogens are expected to behave in a similar manner at higher levels of thermal stress. A large chemical fractionation is observed between retained bitumen and expelled petroleum at 50% fractional conversion. The expelled petroleum is largely composed of hydrocarbons with polar compounds accounting for less than two percent. The composition of the expelled petroleum becomes more similar to the primary product as the kerogen becomes more mature. This is largely due to the decrease in the kerogen's capacity to retain bitumen, rather than its ability to fractionate chemically, as evident in the high polar content of the retained bitumen.

In summary, an extended Flory-Rehner Regular Solution Theory framework according to an exemplary embodiment of the present invention is used to model the equilibrium between kerogens and organic solvents. Thermodynamic parameters that describe kerogen swelling behavior within this formulation (solubility parameter, cross-link density and native swelling) were derived experimentally and then used to model the equilibrium compositions of the expelled petroleum and retained bitumen as a function of maturity. From these calculations, it may be concluded that the amount of generated product relative to the capacity of the kerogen to retain bitumen exerts a controlling influence on expelled fluid composition. Lower source potential and cross-link density promotes bitumen retention and enriches expelled oil in saturated hydrocarbons. Conversely, higher source potential and cross-link density promotes expulsion during early catagenesis and enriches the expelled fluid in polar compounds. The cross-link density of kerogens can vary between organic matter type and level of thermal maturity. In addition, differences in the measured solubility parameter between Type II and IIIC kerogen and variations in the composition of primary generated products appear to exert less influence on the expelled fluid composition. According to the invention, the range in composition of calculated $C_{4+}$ expelled products closely matches that observed in unaltered produced petroleum. The predicted bitumen (kerogen-retained, soluble organic compounds) compositions are dominated by NSO compounds (>50%) at all levels of maturity for all modeled kerogens. The most significant mechanisms for the chemical fractionation that occur during expulsion have been identified and a theoretical model that describes this process has been constructed.

The following discussion relates to a framework for an extended Flory-Rehner and Regular Solution Theory in accordance with an exemplary embodiment of the present invention. According to the invention, a first approximation is made of the amount of generated petroleum that is retained with the kerogen (the Flory-Rehner portion of the framework) through the use of two parameters, an absolute Threshold and a Maximum Retention value. Next, an approximation is made of the process of chemical fractionation (the Regular Solution Theory portion of the framework) through the use of partition factors. These concepts may be implemented in an exemplary CS-CYM such as the CS-CYM described in U.S. Pat. No. 7,344,889, or any other compositional model of hydrocarbon generation from kerogen, coals, asphaltenes, or other complex organic matter.

Two parameters, an absolute Threshold and a Maximum Retention value, are used in the simplified model to express the degree of kerogen swelling which corresponds to the amount of bitumen a kerogen can retain. The Maximum Retention and Threshold values, both of which may be expressed in HI units, mg Hydrocarbons/g Total Organic Carbon, are designed to approximate the effects of the thermodynamic parameters of cross-link density and native swelling factor that are used in the extended Flory-Rehner Regular Solution theory. Collectively, the Threshold and Maximum Retention values define the minimum and maximum amounts of bitumen that may be retained within the kerogen as a function of thermal alteration. In an exemplary embodiment of the present invention, the Threshold represents the minimum value of generated products below which there is no expulsion. The Maximum Retention represents the maximum amount of generated product that may be retained within the kerogen.

Initial Threshold values $T_i$ are dependent on kerogen type and initial HI ($HI_{init}$). These values then vary depending on extent of thermal alteration of that kerogen. In most cases, the Threshold is calculated as a linear fit between the initial Threshold value $T_i$ and the level of kerogen conversion where the threshold goes to zero, $T_0$. That is Threshold=$T_i$×conversion/$T_0$. Conversion is defined based on the initial HI of the starting kerogen and HI of the reacted kerogen: Conversion=($HI_{init}$−HI)/$HI_{init}$. The HI of the reacted kerogen is calculated within CS-CYM from the atomic H/C of the kerogen at each individual time steps by the expression, HI=800×(H/C−0.5). In some cases, such as with Type IIS kerogen, the initial Threshold is lower than the Maximum Retention value then increases with conversion, before decreasing to the $T_0$ point. This mimics the expulsion behavior as modeled by the extended Flory-Rehner Regular Solution theory for kerogens with high initial cross-link density that first decreases with increasing maturity, allowing for a looser, more retentive structure, before decreasing at high levels of maturity.

The initial Maximum Retention value may be fixed depending on kerogen type alone. For example, the initial Maximum Retention values, $Max_i$, are 210, 80, and 50 for Type I, Type II/IIS, and Type III kerogens, respectively. Maximum Retention remains at the initial value until the kerogen obtains and atomic H/C ratio of 0.6 then decreases linearly to zero at an H/C of 0.3.

Once the amount of expelled product and retained bitumen is determined, the composition of the expelled product is calculated using an approximation of the Regular Solution element within a thermodynamic expulsion theory according to an exemplary embodiment of the present invention. The first step is to determine which product molecules generated in the CS-CYM program are to be considered within the "product pool." This is necessary as not all chemical reactions that occur within the kerogen result in the generation of petroleum product. The "product pool" is determined by testing each species produced at each time step to a solubility criteria such that the molecule in question must be soluble (using simple Scatchard-Hildebrand theory) in a specific solvent. In one example, the solvent toluene (δ of toluene is about 18.6 $(J/cm^3)^{1/2}$) is tested against a product with a solubility parameter of 18.0 $(J/cm^3)^{1/2}$. The molecules that meet this criterion are identified and represent the pool of molecules that potentially can be expelled during this timestep.

It is impractical to solve fully partitioning effects as determined by the extended Flory-Rehner Regular Solution theory for all components under any circumstance. The thousand of species generated by the CS-CYM program and identified as part of the "product pool" are then grouped into the chemical lumps as described above. These lumps are then assigned to one or more specific molecules that are representative of the type of molecules in the larger set of molecules within each chemical lump. The full extended Flory-Rehner Regular Solution theory calculation is performed using these representative species. Once solved, each chemical lump is assigned a single partition factor, which may be referred to as a preference factor herein. These preference factors are kerogen type specific. For convenience, the $C_{15+}$ polar lump is set equal to 1 and the other lumps expressed relative the retention tendency of the polar compounds (in other words, less than 1).

In accordance with an exemplary embodiment of the present invention, the preference factor formalism may dictate that for thermodynamic equilibrium to be achieved, the following sum represents the amount of hydrocarbons that are retained in the kerogen, in other words, it would represent the absorbed bitumen:

$$SUM=\Sigma P(i)*amount(i). \tag{5}$$

where the amount is the quantity of the ith lump generated. If the Maximum Retention value is greater than this sum, the Maximum Retention value is reassigned to this sum. This is done to assure that the retained material satisfies the thermodynamic requirement that excess non-polars will be expelled if the Threshold criteria is met. $C_{15+}$ polars will only be expelled if the Maximum Retention value is less than this sum. The amount expelled for each lump is determined by subtracting from the available lump the amount that is in the bitumen. This is the product of the fractional concentration of the lump in the bitumen (based on the preference factors) times the Maximum Retention. From here, the amounts of the lumps which satisfy these constraints can be calculated. At this point, we have determined the amount of bitumen which meets our preference factor formalism and the amounts of the various lumps needed to make it happen. A sum of all lumps that are needed to be expelled to meet particular thermodynamic criterion are compared to the Threshold as defined above. Expulsion occurs only if the amount of this summed lump exceeds the Threshold value. If it is larger than the Threshold, the various lumps are proportionally expelled as to meet the thermodynamic requirement of Regular Solution theory.

The composition of the, retained fluid $\{y_i\}$ is given by:

$$y_i = \frac{P_i x_i}{\sum_i P_j x_j}. \tag{6}$$

when in equilibrium with known fluid composition of $\{x_{i's}\}$.

When the Threshold goes to zero, the retained bitumen will exactly meet the preference factor criterion. The amount of retained bitumen is determined by subtracting the expelled material from the total available.

Figure 8:
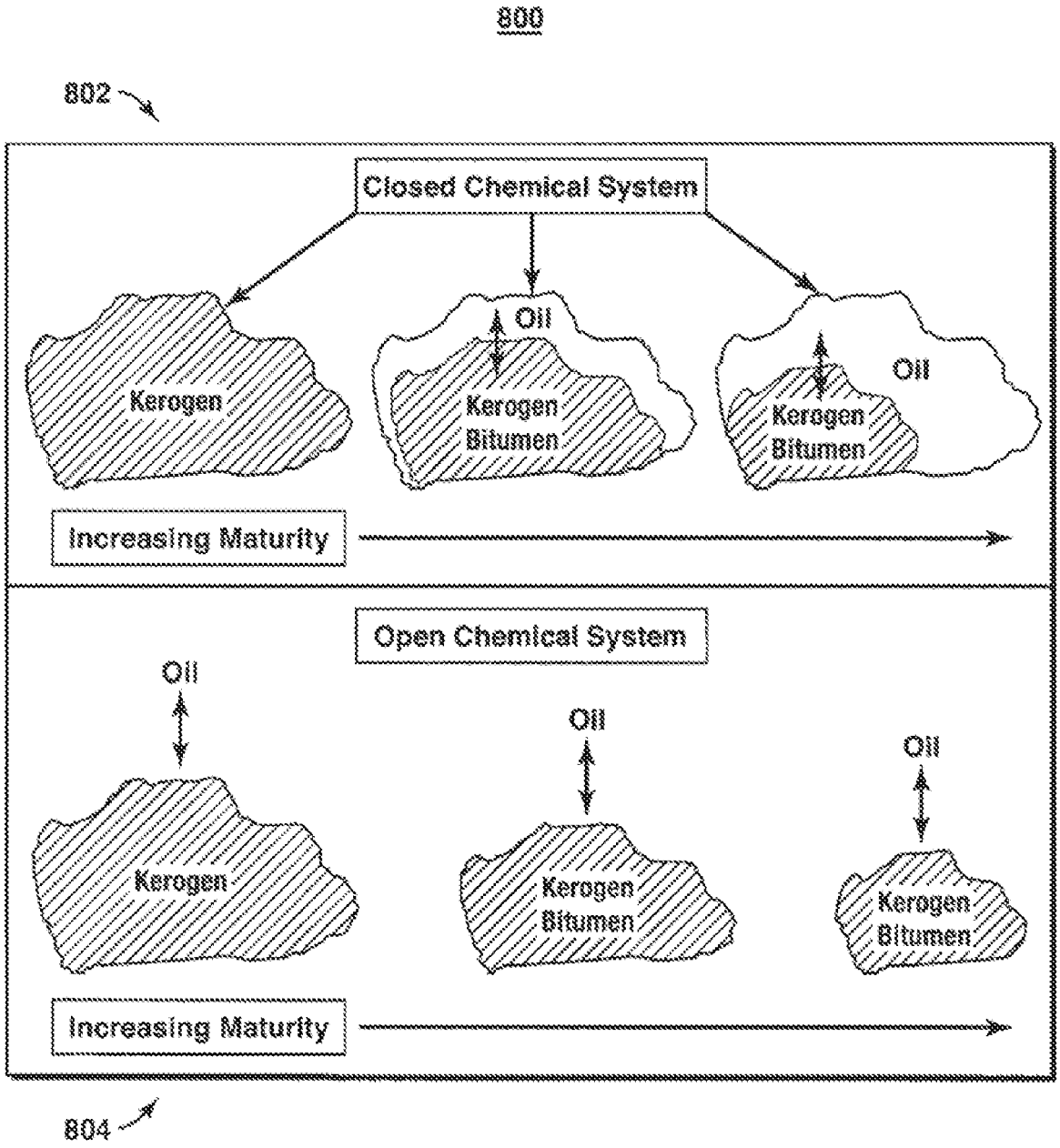
FIG. 8 is a diagram showing closed- and open-systems for a model of thermal maturation into kerogen, bitumen and expelled oil in accordance with an exemplary embodiment of the present invention.

FIG. 8 is a diagram showing closed- and open-systems for a model of thermal maturation into kerogen, bitumen and expelled oil in accordance with an exemplary embodiment of the present invention. The diagram is generally referred to by the reference number 800. An upper panel 802 corresponds to a closed chemical system. A lower panel 804 corresponds to an open chemical system. As described below, partition factors differ for closed and open systems. In particular, FIG. 8 illustrates the differences between the closed- and open-systems for the thermal maturation into kerogen, bitumen and expelled oil.

The release of hydrocarbons from kerogen depends on chemical driving forces and the local kerogen/hydrocarbon physical environment. For a closed system as a function of maturity, the relative amount of primary generated oil and kerogen will be variable and this will affect the partitioning between retained and free oil. The capacity for kerogen to retain bitumen is limited for the most part by the cross-link density. Experimentally, this manifests itself by the ability of a kerogen to swell when exposed to solvents. For a closed system both the amount kerogen and primary generated hydrocarbons are well-defined as a function of maturity for each organic matter type. The closed system situation approaches the natural chemical situation where there is a limited amount of generated oil in contact with kerogen.

In a model open-system, there is an excess amount of compositionally well-defined primary generated oil available for interaction with kerogen at all stages of maturation. The model calculation determines the composition of bitumen that is in equilibrium with the oil. At first glance this might appear to be an unusual/unnatural situation; however, it closely corresponds to two useful limiting situations. Consider the first situation for a very rich kerogen source (high HI). At high maturity the mass of generated oil will considerably exceed the mass of residual kerogen. It is anticipated and in fact found that the fractionation results (reflected in derived preference factors) determined for an open system approaches the closed system results. Highly cross-linked kerogen represents another situation where the results from an open system model calculation approaches the results from a closed system. In this case the relative capacity of kerogen to retain bitumen is unusually low so that there is an effective excess amount of oil available for interaction with kerogen. In the case of closed system model calculations, it is not meaningful to report the composition of the retained and expelled oil fractions since the "expelled" oil composition is by definition the composition of the primary generated hydrocarbons. However, the derived preference factor for retention of each molecular lump is relevant.

The extended Flory-Rehner Regular Solution theory was solved using the surrogate compounds for different kerogen types under open and closed conditions. From these solutions, partition factors were determined based on the compositional lumping scheme used by CS-CYM for the Advanced Composition Model. The partition factors are listed in Tables 4 and 5 for four example kerogens: Type II (marine organic matter), Type IIS (high-sulfur marine organic matter), Type IIIC (terrestrial organic matter with high hydrogen content), and Type IIICS (terrestrial organic matter with high hydrogen and sulfur content).

TABLE 4a

Preference Factors for Retained Oil (Closed System)
Preference Factors - Closed System - 13 Component (NSO-$C_{10}$)

Type II Kerogen Closed System (HI = 650 mg/g) Preference Factors

| | Kerogen | | | |
|---|---|---|---|---|
| Component | Type II 25% HI | Type II 50% HI | Type II 75% HI | Type II 100% HI |
| Methane | — | 0.000567 | 0.003010 | 0.024565 |
| Ethane | — | 0.000567 | 0.002658 | 0.017853 |
| Propane | — | 0.000523 | 0.002171 | 0.012045 |
| Butane | — | 0.000491 | 0.001801 | 0.008208 |
| Pentane | — | 0.000566 | 0.001857 | 0.007037 |
| $C_6$-$C_{14}$ Sats | — | 0.000879 | 0.001909 | 0.003116 |
| $C_6$-$C_{14}$ Aros | — | 0.016487 | 0.060290 | 0.214116 |
| $C_{14}^+$ Sats | — | 0.001184 | 0.001554 | 0.000849 |
| $C_{14}^+$ Aros | — | 0.015535 | 0.045923 | 0.276071 |
| $C_{14}^+$ NSOs | — | 1.000000 | 1.000000 | 1.000000 |

TABLE 4a-continued

Preference Factors for Retained Oil (Closed System)
Preference Factors - Closed System - 13 Component (NSO-$C_{10}$)

Type IIS Kerogen Closed System (HI = 650 mg/g) Preference Factors

| | Kerogen | | | |
|---|---|---|---|---|
| Component | Type IIS 25% HI | Type IIS 50% HI | Type IIS 75% HI | Type IIS 100% HI |
| Methane | — | 0.002189 | 0.034156 | 0.062440 |
| Ethane | — | 0.001979 | 0.025380 | 0.043657 |
| Propane | — | 0.001662 | 0.017628 | 0.028588 |
| Butane | — | 0.001420 | 0.012351 | 0.018848 |
| Pentane | — | 0.001500 | 0.010667 | 0.015340 |
| $C_6$-$C_{14}$ Sats | — | 0.001715 | 0.004847 | 0.005452 |
| $C_6$-$C_{14}$ Aros | — | 0.046181 | 0.235041 | 0.304303 |
| $C_{14}^+$ Sats | — | 0.001605 | 0.001415 | 0.001101 |
| $C_{14}^+$ Aros | — | 0.033195 | 0.290980 | 0.305952 |
| $C_{14}^+$ NSOs | — | 1.000000 | 1.000000 | 1.000000 |

Type IIS Kerogen Closed System (HI = 400 mg/g) Preference Factors

| | Kerogen | | | |
|---|---|---|---|---|
| Component | Type IIS 25% HI | Type IIS 50% HI | Type IIS 75% HI | Type IIS 100% HI |
| Methane | — | 0.000369 | 0.005893 | 0.038921 |
| Ethane | — | 0.000370 | 0.004891 | 0.027636 |
| Propane | — | 0.000340 | 0.003742 | 0.018269 |
| Butane | — | 0.000319 | 0.002905 | 0.012182 |
| Pentane | — | 0.000371 | 0.002839 | 0.010171 |
| $C_6$-$C_{14}$ Sats | — | 0.000599 | 0.002274 | 0.004022 |
| $C_6$-$C_{14}$ Aros | — | 0.013072 | 0.103000 | 0.267414 |
| $C_{14}^+$ Sats | — | 0.000831 | 0.001344 | 0.000938 |
| $C_{14}^+$ Aros | — | 0.012000 | 0.082855 | 0.303847 |
| $C_{14}^+$ NSOs | — | 1.000000 | 1.000000 | 1.000000 |

TABLE 4b

Preference Factors for Retained Oil (Closed System)
Preference Factors - Closed System - 13 Component (NSO-$C_{10}$)

Type IIIC Kerogen Closed System (HI = 350 mg/g) Preference Factors

| | Kerogen | | | |
|---|---|---|---|---|
| Component | Type IIIC 25% HI | Type IIIC 50% HI | Type IIIC 75% HI | Type IIIC 100% HI |
| Methane | — | 0.000185 | 0.005200 | 0.028571 |
| Ethane | — | 0.000182 | 0.004001 | 0.017919 |
| Propane | — | 0.000162 | 0.002808 | 0.010307 |
| Butane | — | 0.000148 | 0.002002 | 0.005983 |
| Pentane | — | 0.000173 | 0.001870 | 0.004583 |
| $C_6$-$C_{14}$ Sats | — | 0.000310 | 0.001244 | 0.001315 |
| $C_6$-$C_{14}$ Aros | — | 0.009789 | 0.125336 | 0.244894 |
| $C_{14}^+$ Sats | — | 0.000460 | 0.000537 | 0.000170 |
| $C_{14}^+$ Aros | — | 0.007537 | 0.138070 | 0.290222 |
| $C_{14}^+$ NSOs | — | 1.000000 | 1.000000 | 1.000000 |

Type IIIC Kerogen Closed System (HI = 200 mg/g) Preference Factors

| | Kerogen | | | |
|---|---|---|---|---|
| Component | Type IIIC 25% HI | Type IIIC 50% HI | Type IIIC 75% HI | Type IIIC 100% HI |
| Methane | — | — | 0.000447 | 0.019069 |
| Ethane | — | — | 0.000405 | 0.012380 |
| Propane | — | — | 0.000332 | 0.007334 |
| Butane | — | — | 0.000277 | 0.004394 |
| Pentane | — | — | 0.000302 | 0.003508 |
| $C_6$-$C_{14}$ Sats | — | — | 0.000413 | 0.001187 |
| $C_6$-$C_{14}$ Aros | — | — | 0.020297 | 0.233622 |
| $C_{14}^+$ Sats | — | — | 0.000432 | 0.000196 |

TABLE 4b-continued

| Preference Factors for Retained Oil (Closed System) Preference Factors - Closed System - 13 Component (NSO-$C_{10}$) | | | | |
|---|---|---|---|---|
| $C_{14}^+$ Aros | — | — | 0.010427 | 0.280696 |
| $C_{14}^+$ NSOs | — | — | 1.000000 | 1.000000 |
| Type IIICS Kerogen Closed System (HI = 350 mg/g) Preference Factors | | | | |
| | Kerogen | | | |
| Component | Type IIICS 25% HI | Type IIICS 50% HI | Type IIICS 75% HI | Type IIICS 100% HI |
| Methane | — | 0.000163 | 0.006245 | 0.033524 |
| Ethane | — | 0.000161 | 0.004706 | 0.020868 |
| Propane | — | 0.000143 | 0.003232 | 0.011924 |
| Butane | — | 0.000131 | 0.002254 | 0.006873 |
| Pentane | — | 0.000154 | 0.002067 | 0.005221 |
| $C_6$-$C_{14}$ Sats | — | 0.000278 | 0.001264 | 0.001451 |
| $C_6$-$C_{14}$ Aros | — | 0.009181 | 0.142472 | 0.266201 |
| $C_{14}^+$ Sats | — | 0.000416 | 0.000488 | 0.000178 |
| $C_{14}^+$ Aros | — | 0.006957 | 0.162686 | 0.292992 |
| $C_{14}^+$ NSOs | — | 1.000000 | 1.000000 | 1.000000 |

TABLE 4c

| Preference Factors for Retained Oil (Closed System) Preference Factors - Closed System - 13 Component (NSO-$C_{10}$) | | | | |
|---|---|---|---|---|
| | Kerogen | | | |
| Component | Type IIICS 25% HI | Type IIICS 50% HI | Type IIICS 75% HI | Type IIICS 100% HI |
| TYPE IIICS KEROGEN CLOSED SYSTEM (HI = 350 MG/G) PREFERENCE FACTORS | | | | |
| Methane | — | — | 0.000457 | 0.021901 |
| Ethane | — | — | 0.000406 | 0.014029 |
| Propane | — | — | 0.000329 | 0.008203 |
| Butane | — | — | 0.000272 | 0.004849 |
| Pentane | — | — | 0.000295 | 0.003820 |
| $C_6$-$C_{14}$ Sats | — | — | 0.000395 | 0.001226 |
| $C_6$-$C_{14}$ Aros | — | — | 0.021060 | 0.247471 |
| $C_{14}^+$ Sats | — | — | 0.000397 | 0.000187 |
| $C_{14}^+$ Aros | — | — | 0.010469 | 0.288483 |
| $C_{14}^+$ NSOs | — | — | 1.000000 | 1.000000 |
| Type I (A) Kerogen Closed System (HI = 800 mg/g) Preference Factors | | | | |
| Methane | — | 0.058473 | 0.223041 | 0.276931 |
| Ethane | — | 0.048693 | 0.175138 | 0.207320 |
| Propane | — | 0.038501 | 0.131772 | 0.148380 |
| Butane | — | 0.030684 | 0.099566 | 0.106578 |
| Pentane | — | 0.028580 | 0.086384 | 0.088873 |
| $C_6$-$C_{14}$ Sats | — | 0.017895 | 0.039906 | 0.034771 |
| $C_6$-$C_{14}$ Aros | — | 0.292748 | 0.582632 | 0.657381 |
| $C_{14}^+$ Sats | — | 0.008780 | 0.013042 | 0.008763 |
| $C_{14}^+$ Aros | — | 0.226566 | 0.427549 | 0.409494 |
| $C_{14}^+$ NSOs | — | 1.000000 | 1.000000 | 1.000000 |
| Type I (A) Kerogen Closed System (HI = 800 mg/g) Preference Factors | | | | |
| Methane | — | 0.048631 | 0.365366 | 0.276948 |
| Ethane | — | 0.044231 | 0.296766 | 0.207322 |
| Propane | — | 0.038577 | 0.232839 | 0.148384 |
| Butane | — | 0.033906 | 0.183254 | 0.106582 |
| Pentane | — | 0.033600 | 0.161537 | 0.088876 |
| $C_6$-$C_{14}$ Sats | — | 0.027831 | 0.080410 | 0.034773 |
| $C_6$-$C_{14}$ Aros | — | 0.218361 | 0.747666 | 0.657419 |
| $C_{14}^+$ Sats | — | 0.020154 | 0.029963 | 0.008764 |
| $C_{14}^+$ Aros | — | 0.154000 | 0.489013 | 0.409531 |
| $C_{14}^+$ NSOs | — | 1.000000 | 1.000000 | 1.000000 |

TABLE 5b

| Preference Factors for Retained Oil (Open System) Preference Factors - Open System - 13 Component (NSO-$C_{10}$) | | | | |
|---|---|---|---|---|
| Type II Kerogen Open System Preference Factors | | | | |
| | Kerogen | | | |
| Component | Type II 25% HI | Type II 50% HI | Type II 75% HI | Type II 100% HI |
| Methane | 0.042915 | 0.042915 | 0.048837 | 0.049998 |
| Ethane | 0.024201 | 0.032589 | 0.035280 | 0.034359 |
| Propane | 0.023380 | 0.023380 | 0.023979 | 0.022110 |
| Butane | 0.016887 | 0.016887 | 0.016405 | 0.014320 |
| Pentane | 0.014588 | 0.014588 | 0.013642 | 0.011476 |
| $C_6$-$C_{14}$ Sats | 0.006616 | 0.006616 | 0.005281 | 0.003840 |
| $C_6$-$C_{14}$ Aros | 0.199316 | 0.199316 | 0.222381 | 0.230329 |
| $C_{14}^+$ Sats | 0.002000 | 0.002000 | 0.001240 | 0.000702 |
| $C_{14}^+$ Aros | 0.262241 | 0.262242 | 0.246179 | 0.221540 |
| $C_{14}^+$ NSOs | 1.000000 | 1.000000 | 1.000000 | 1.000000 |
| Type IIS Kerogen Open System Preference Factors | | | | |
| | Kerogen | | | |
| Component | Type IIS 25% HI | Type IIS 50% HI | Type IIS 75% HI | Type IIS 100% HI |
| Methane | 0.063970 | 0.063970 | 0.071620 | 0.073004 |
| Ethane | 0.024334 | 0.048651 | 0.051824 | 0.050240 |
| Propane | 0.035066 | 0.035066 | 0.035388 | 0.032470 |
| Butane | 0.025429 | 0.025429 | 0.024307 | 0.021107 |
| Pentane | 0.021867 | 0.021867 | 0.020128 | 0.016842 |
| $C_6$-$C_{14}$ Sats | 0.009725 | 0.009725 | 0.007652 | 0.005532 |
| $C_6$-$C_{14}$ Aros | 0.254630 | 0.254630 | 0.281143 | 0.290314 |
| $C_{14}^+$ Sats | 0.002888 | 0.002888 | 0.001766 | 0.000993 |
| $C_{14}^+$ Aros | 0.286286 | 0.286286 | 0.267653 | 0.240230 |
| $C_{14}^+$ NSOs | 1.000000 | 1.000000 | 1.000000 | 1.000000 |
| Type IIIC Kerogen Open System Preference Factors | | | | |
| | Kerogen | | | |
| Component | Type IIIC 25% HI | Type IIIC 50% HI | Type IIIC 75% HI | Type IIIC 100% HI |
| Methane | 0.016886 | 0.016886 | 0.022007 | 0.031901 |
| Ethane | 0.046607 | 0.011740 | 0.014301 | 0.018995 |
| Propane | 0.007590 | 0.007590 | 0.008603 | 0.010417 |
| Butane | 0.004948 | 0.004948 | 0.005216 | 0.005752 |
| Pentane | 0.004061 | 0.004061 | 0.004057 | 0.004168 |
| $C_6$-$C_{14}$ Sats | 0.001501 | 0.001501 | 0.001221 | 0.000975 |
| $C_6$-$C_{14}$ Aros | 0.118180 | 0.118179 | 0.141617 | 0.177963 |
| $C_{14}^+$ Sats | 0.000313 | 0.000313 | 0.000178 | 0.000088 |
| $C_{14}^+$ Aros | 0.184115 | 0.184110 | 0.163627 | 0.134257 |
| $C_{14}^+$ NSOs | 1.000000 | 1.000000 | 1.000000 | 1.000000 |

TABLE 5c

| Preference Factors for Retained Oil (Open System) Preference Factors - Open System - 13 Component (NSO-$C_{10}$) | | | | |
|---|---|---|---|---|
| | Kerogen | | | |
| Component | Type IIICS 25% HI | Type IIICS 50% HI | Type IIICS 75% HI | Type IIICS 100% HI |
| Type IIICS Kerogen Open System Preference Factors | | | | |
| Methane | 0.019867 | 0.019867 | 0.025954 | 0.037700 |
| Ethane | 0.047953 | 0.013763 | 0.016805 | 0.022362 |
| Propane | 0.008873 | 0.008873 | 0.010082 | 0.012227 |
| Butane | 0.005767 | 0.005767 | 0.006094 | 0.006729 |
| Pentane | 0.004710 | 0.004710 | 0.004716 | 0.004851 |
| $C_6$-$C_{14}$ Sats | 0.001705 | 0.001705 | 0.001391 | 0.001113 |
| $C_6$-$C_{14}$ Aros | 0.130689 | 0.130690 | 0.156639 | 0.196818 |
| $C_{14}^+$ Sats | 0.000345 | 0.000345 | 0.000197 | 0.000098 |

TABLE 5c-continued

| Preference Factors for Retained Oil (Open System) Preference Factors - Open System - 13 Component (NSO-$C_{10}$) | | | | |
|---|---|---|---|---|
| | Kerogen | | | |
| Component | Type IIICS 25% HI | Type IIICS 50% HI | Type IIICS 75% HI | Type IIICS 100% HI |
| $C_{14}^+$ Aros | 0.188348 | 0.188351 | 0.167051 | 0.136700 |
| $C_{14}^+$ NSOs | 1.000000 | 1.000000 | 1.000000 | 1.000000 |
| Type I (A) Kerogen Open System Preference Factors | | | | |
| Methane | 0.290232 | 0.290241 | 0.292230 | 0.291349 |
| Ethane | 0.006946 | 0.238089 | 0.229105 | 0.217602 |
| Propane | 0.188777 | 0.188778 | 0.172757 | 0.155512 |
| Butane | 0.150165 | 0.150166 | 0.130696 | 0.111509 |
| Pentane | 0.133423 | 0.133423 | 0.112424 | 0.092628 |
| $C_6$-$C_{14}$ Sats | 0.069157 | 0.069158 | 0.050333 | 0.035710 |
| $C_6$-$C_{14}$ Aros | 0.610033 | 0.610036 | 0.636878 | 0.656810 |
| $C_{14}^+$ Sats | 0.027099 | 0.027100 | 0.015782 | 0.008805 |
| $C_{14}^+$ Aros | 0.457706 | 0.457709 | 0.428138 | 0.392110 |
| $C_{14}^+$ NSOs | 1.000000 | 1.000000 | 1.000000 | 1.000000 |
| Type I (B) Kerogen Open System Preference Factors | | | | |
| Methane | 0.573272 | 0.573330 | 0.470572 | 0.291347 |
| Ethane | 0.006724 | 0.511941 | 0.382584 | 0.217603 |
| Propane | 0.448557 | 0.448589 | 0.301466 | 0.155512 |
| Butane | 0.393725 | 0.393753 | 0.238106 | 0.111509 |
| Pentane | 0.367590 | 0.367617 | 0.208753 | 0.092628 |
| $C_6$-$C_{14}$ Sats | 0.245668 | 0.245688 | 0.102291 | 0.035710 |
| $C_6$-$C_{14}$ Aros | 0.845308 | 0.845348 | 0.829551 | 0.656813 |
| $C_{14}^+$ Sats | 0.140786 | 0.140800 | 0.037283 | 0.008805 |
| $C_{14}^+$ Aros | 0.623529 | 0.623558 | 0.512848 | 0.392112 |
| $C_{14}^+$ NSOs | 1.000000 | 1.000000 | 1.000000 | 1.000000 |

Figure 9:
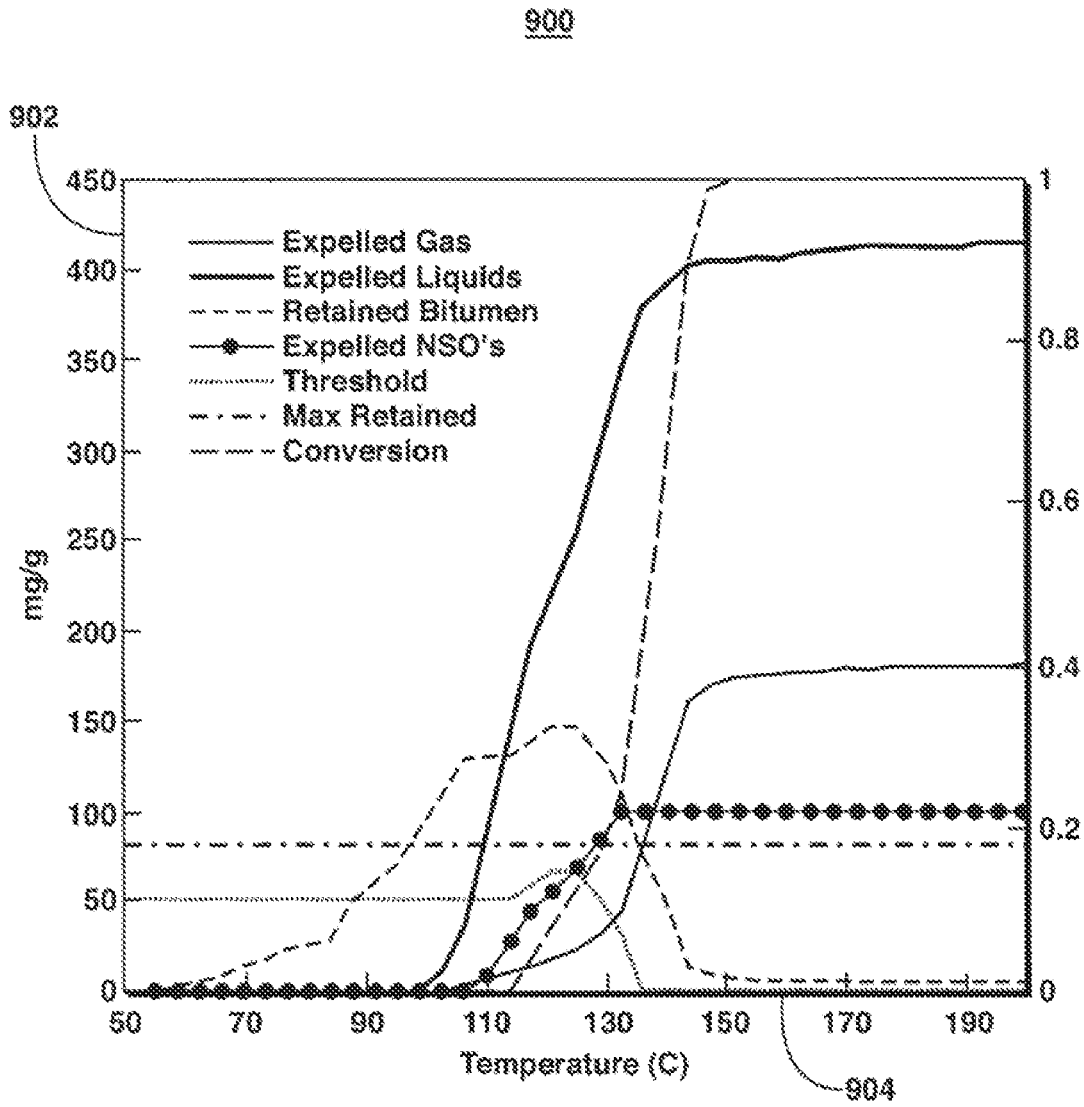
FIG. 9 is a graph showing projected hydrocarbon expulsion according to an exemplary embodiment of the present invention.
Figure 10:
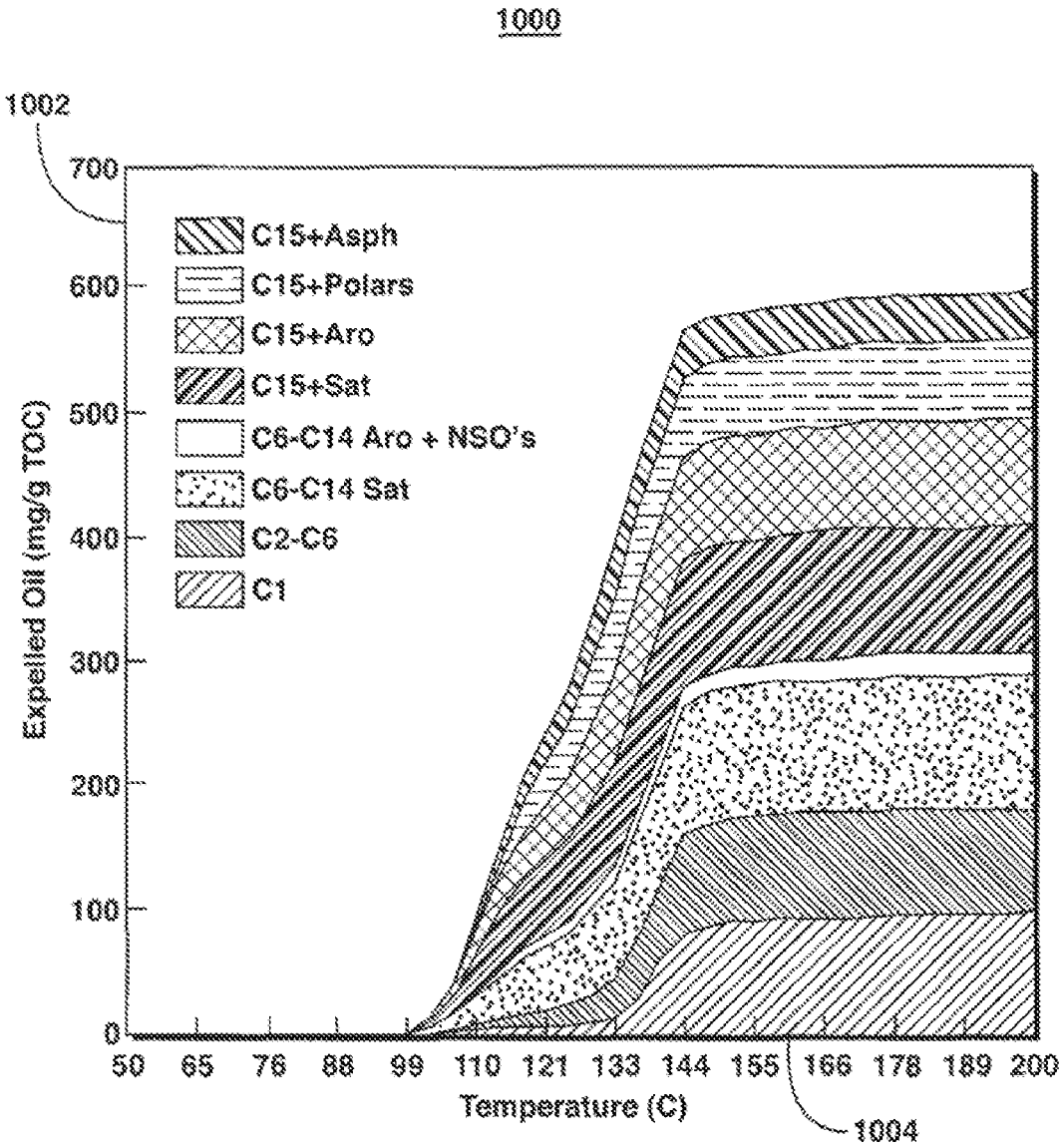
FIG. 10 is a graph showing projected cumulative compositional yields of expelled petroleum according to an exemplary embodiment of the present invention.

An exemplary embodiment of the present invention has been incorporated into a CS-CYM basin modeling program as an improved method for calculating the amount and composition of petroleum that is expelled from the source kerogen. The results of one experiment are shown in FIG. 9 and FIG. 10. Here, a Type IIS (sulfur-rich marine) kerogen is subjected to temperatures from 50 to 200° C. at a 4° C./Ma heating rate. The Maximum Retention value is fixed at 75 mg/g TOC, while the Threshold value varies with kerogen maturation reflecting the changing swelling nature (capacity) of the kerogen. Also plotted are the amount of expelled gases and liquids, the amount of NSO compounds expelled (a subset of the expelled liquids, and the amount of retained bitumen).

FIG. 9 is a graph showing projected hydrocarbon expulsion according to an exemplary embodiment of the present invention. The graph is generally referred to by the reference number 900. The graph 900 shows a y-axis 902 corresponding to a yield of various expelled products in mg/g. An x-axis 904 corresponds to temperature in degrees Centigrade. The data shown in the graph 900 is for a Type IIS kerogen reacted at 4° C./Ma. Fractional conversion is shown as a percentage (0 to 1) on the right scale.

FIG. 10 is a graph showing projected cumulative compositional yields of expelled petroleum according to an exemplary embodiment of the present invention. The graph is generally referred to by the reference number 1000. A y-axis 1002 corresponds to a volume of expelled oil in mg/g TOC. An x-axis 1004 corresponds to temperature in Centigrade degrees. The data shown in the graph 1000 is for a Type IIS kerogen reacted at 4° C./Ma.

An exemplary embodiment of the present invention provides significant improvement with respect to accurately predicting petroleum expulsion. Such improvement has been realized in a CY-CSM basin modelling program.

Figure 11:
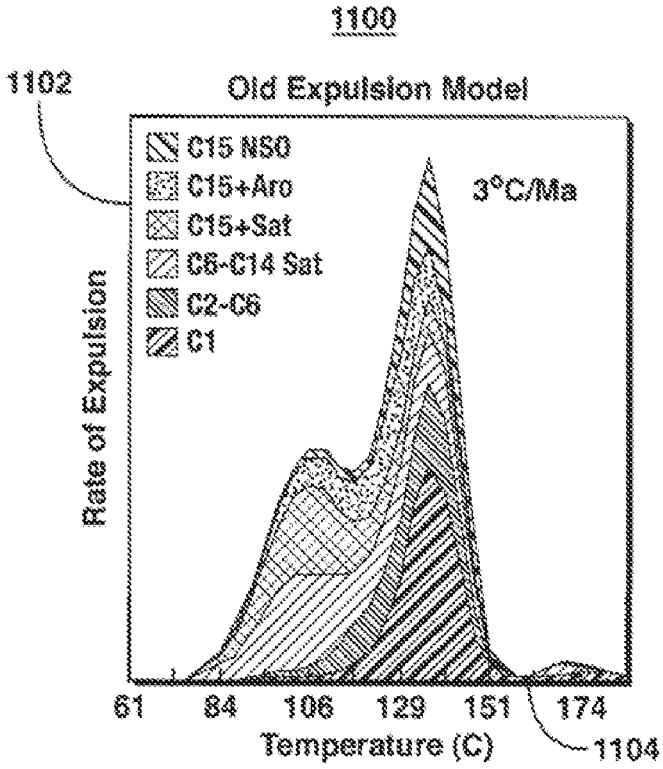
FIG. 11 is a graph showing a projected composition of expelled products expressed as a rate according to a known expulsion model.

FIG. 11 is a graph showing a projected composition of expelled products expressed as a rate according to a known expulsion model. The graph is generally referred to by the reference number 1100. The graph 1100 includes a y-axis 1102, which corresponds to a rate of petroleum expulsion in units of mg expelled component/g total organic carbon/1.5×$10^6$ years. An x-axis 1104 corresponds to temperature in Centigrade degrees.

Figure 12:
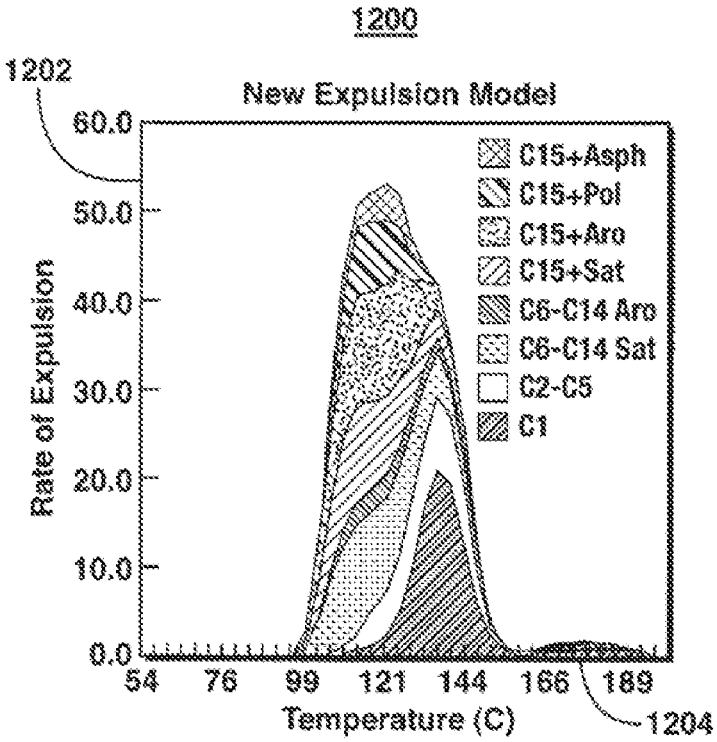
FIG. 12 is a graph showing a projected composition of expelled products expressed as a rate according to an exemplary embodiment of the present invention.

FIG. 12 is a graph showing a projected composition of expelled products expressed as a rate according to an exemplary embodiment of the present invention. The graph is generally referred to by the reference number 1200. The graph 1200 includes a y-axis 1202, which corresponds to a rate of petroleum expulsion in units of mg expelled component/g total organic carbon/1.5×$10^6$ years. An x-axis 1204 corresponds to temperature in Centigrade degrees.

In the prediction provided by an exemplary embodiment of the present invention (FIG. 12), the timing, quantity, and composition of the expelled fluids more closely matches the conditions of natural geologic systems. For example, in the prediction provided by a known basin modeling program (FIG. 11), polars were selectively retained based on their solubility parameter and were preferentially expelled late the generative phase. This result is inconsistent with geologic observations that indicate that the polar compounds are expelled early in the generative phase. This difference is correctly modeled by an exemplary embodiment of the present invention.

Figure 13:
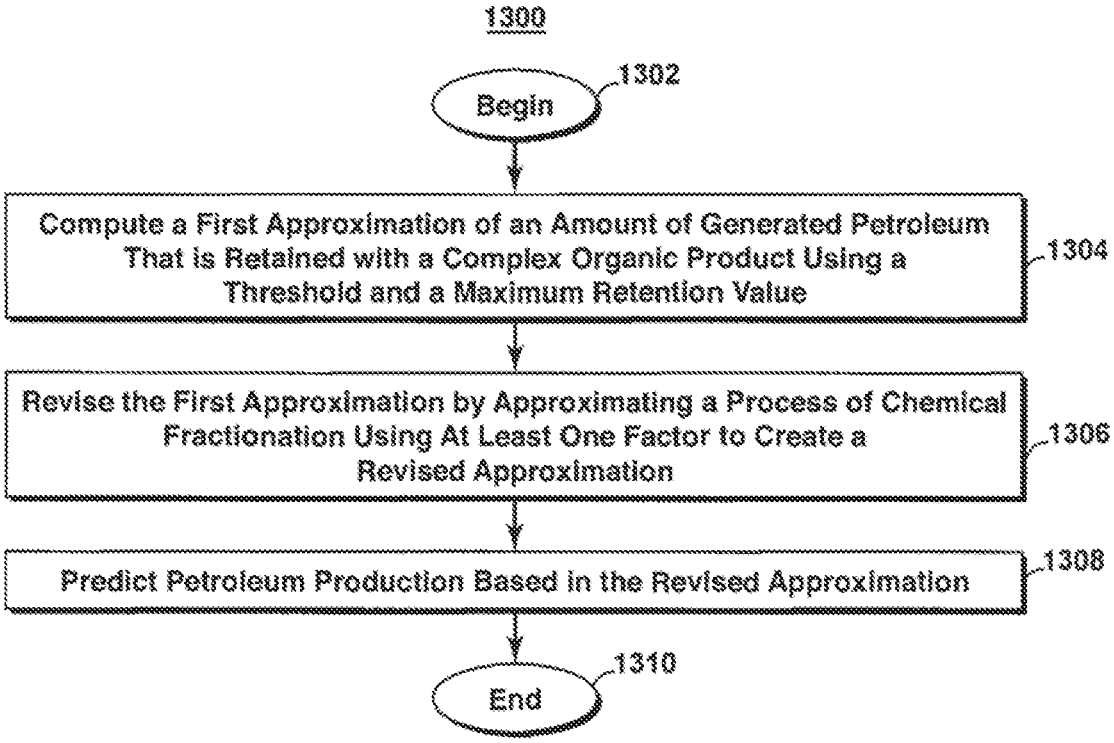
FIG. 13 is a process flow diagram showing a method for predicting hydrocarbon expulsion in accordance with an exemplary embodiment of the present invention.

FIG. 13 is a process flow diagram showing a method for predicting hydrocarbon expulsion in accordance with an exemplary embodiment of the present invention. The method is generally referred to by the reference number 1300. At block 1302, the method begins.

At block 1304, a first approximation of an amount of generated petroleum that is retained with a complex organic product is computed using a Threshold and a Maximum Retention value. The first approximation is revised by approximating a process of chemical fractionation using at least one partition factor to create a revised approximation, as shown at block 1306. Petroleum production is predicted based on the revised approximation, as shown at block 1308. The method ends at block 1310.

Figure 14:
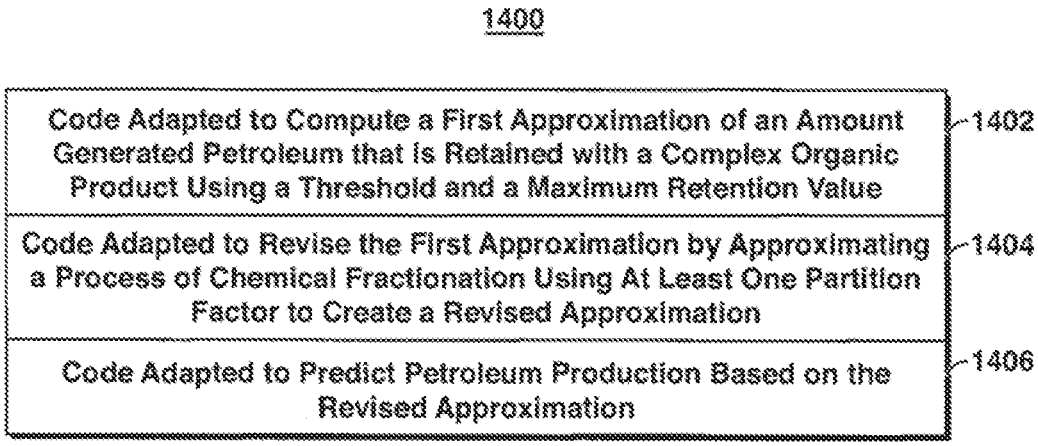
FIG. 14 is a diagram of a tangible, machine-readable medium in accordance with an exemplary embodiment of the present invention.

FIG. 14 is a diagram of a tangible, machine-readable medium in accordance with an exemplary embodiment of the present invention. The exemplary tangible, machine-readable medium is generally referred to by the reference number 1400. The tangible, machine-readable medium 1400 may comprise a disk drive such as a magnetic or optical disk or the like. In an exemplary embodiment of the present invention, the tangible, machine-readable medium 1400 comprises code 1402 adapted to compute a first approximation of an amount of generated petroleum that is retained with a complex organic product using a Threshold and a Maximum Retention value. The exemplary tangible, machine-readable 1400 also comprises code 1404 adapted to revise the first approximation by approximating a process of chemical fractionation using at least one partition factor to create a revised approximation and code 1406 adapted to predict petroleum production based on the revised approximation.

Figure 15:
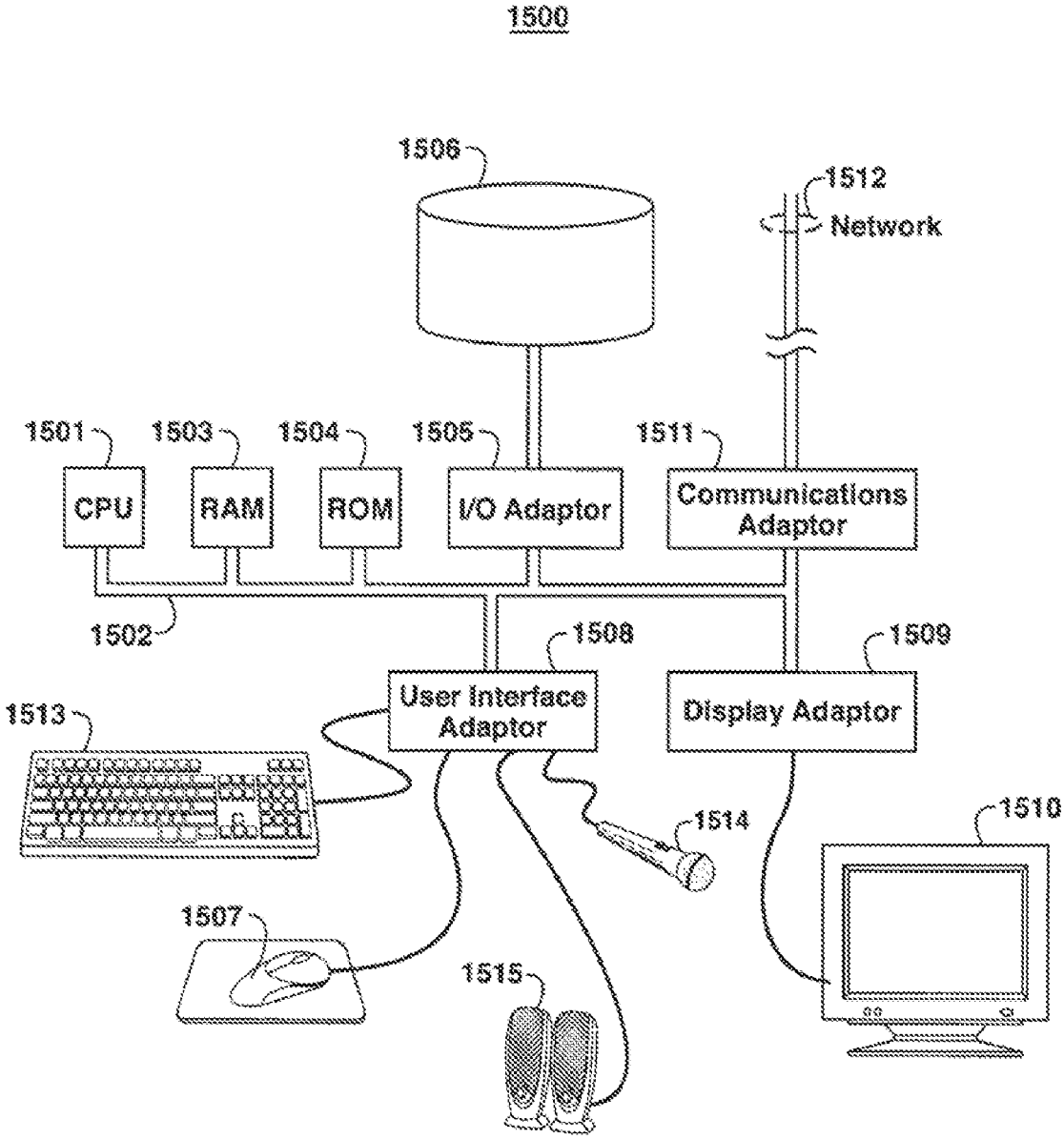
FIG. 15 illustrates an exemplary computer network that may be used to perform the method for predicting hydrocarbon expulsion as disclosed herein, and is discussed in greater detail below.

FIG. 15 illustrates an exemplary computer system 1500 on which software for performing processing operations of embodiments of the present invention may be implemented. A central processing unit (CPU) 1501 is coupled to system bus 1502. The CPU 1501 may be any general-purpose CPU. The present invention is not restricted by the architecture of CPU 1501 (or other components of exemplary system 1500) as long as CPU 1501 (and other components of system 1500)

supports the inventive operations as described herein. The CPU 1501 may execute the various logical instructions according to embodiments. For example, the CPU 1501 may execute machine-level instructions for performing processing according to the exemplary operational flow described above in conjunction with FIG. 13. For instance, CPU 1501 may execute machine-level instructions for performing operational block 1304 of FIG. 13, as an example.

The computer system 1500 also preferably includes random access memory (RAM) 1503, which may be SRAM, DRAM, SDRAM, or the like. The computer system 1500 preferably includes read-only memory (ROM) 1504 which may be PROM, EPROM, EEPROM, or the like. The RAM 1503 and the ROM 1504 hold user and system data and programs, as is well-known in the art. The computer system 1500 also preferably includes an input/output (I/O) adapter 1505, a communications adapter 1511, a user interface adapter 1508, and a display adapter 1509. The I/O adapter 1505, the user interface adapter 1508, and/or communications adapter 1511 may, in certain embodiments, enable a user to interact with computer system 1500 in order to input information.

The I/O adapter 1505 preferably connects to a storage device(s) 1506, such as one or more of hard drive, compact disc (CD) drive, floppy disk drive, tape drive, etc. to computer system 1500. The storage devices may be utilized when the RAM 1503 is insufficient for the memory requirements associated with storing data for operations of embodiments of the present invention. The data storage of the computer system 1500 may be used for storing information and/or other data used or generated in accordance with embodiments of the present invention. The communications adapter 1511 is preferably adapted to couple the computer system 1500 to a network 1512, which may enable information to be input to and/or output from system 1500 via such network 1512 (e.g., the Internet or other wide-area network, a local-area network, a public or private switched telephony network, a wireless network, any combination of the foregoing). The user interface adapter 1508 couples user input devices, such as a keyboard 1513, a pointing device 1507, and a microphone 1514 and/or output devices, such as a speaker(s) 1515 to the computer system 1500. The display adapter 1509 is driven by the CPU 1501 to control the display on a display device 1510 to, for example, display information or a representation pertaining to a portion of a subsurface region under analysis, such as displaying a generated 3D representation of a target area, according to certain embodiments.

It shall be appreciated that the present invention is not limited to the architecture of system 1500. For example, any suitable processor-based device may be utilized for implementing all or a portion of embodiments of the present invention, including without limitation personal computers, laptop computers, computer workstations, and multi-processor servers. Moreover, embodiments may be implemented on application specific integrated circuits (ASICs) or very large scale integrated (VLSI) circuits. In fact, persons of ordinary skill in the art may utilize any number of suitable structures capable of executing logical operations according to the embodiments.

While the present invention may be susceptible to various modifications and alternative forms, the exemplary embodiments discussed above have been shown only by way of example. However, it should again be understood that the invention is not intended to be limited to the particular embodiments disclosed herein. Indeed, the present invention includes all alternatives, modifications, and equivalents falling within the true spirit and scope of the appended claims.

What is claimed is:

1. A computer-implemented method for predicting petroleum production,the method comprising:

computing using a computer a first approximation of an amount of generated petroleum that is retained with a complex organic product using a Threshold value and a Maximum Retention value;

revising using a computer the first approximation by approximating a process of chemical fractionation using at least one partition factor to create a revised approximation; and predicting petroleum production based on the revised approximation.

2. The computer-implemented method for predicting petroleum production recited in claim 1, wherein the complex organic product comprises a kerogen.

3. The computer-implemented method for predicting petroleum production recited in claim 1, wherein the complex organic product comprises an asphaltene.

4. The computer-implemented method for predicting petroleum production recited in claim 1, wherein the first approximation is generated by modeling a closed system.

5. The computer-implemented method for predicting petroleum production recited in claim 1, wherein the Threshold value and the Maximum Retention value describe a degree of swelling corresponding to an amount of bitumen the complex organic product can retain.

6. The computer-implemented method for predicting petroleum production recited in claim 1, wherein at least one of the Threshold value and the Maximum Retention value are expressed in Hydrogen Index units.

7. The computer-implemented method for predicting petroleum production recited in claim 1, wherein the first approximation represents the effects of thermodynamic parameters including a solubility parameter, a cross-link density, and a native swelling factor.

8. The computer-implemented method for predicting petroleum production recited in claim 1, wherein the Threshold value and the Maximum Retention value respectively define a minimum and a maximum amount of bitumen that may be retained within the complex organic product as a function of thermal alteration.

9. The computer-implemented method for predicting petroleum production recited in claim 1, wherein the Threshold value and the Maximum Retention value respectively define a minimum value of generated products below which there is no expulsion and a maximum amount of generated product that may be retained within the complex organic product.

10. The computer-implemented method for predicting petroleum production recited in claim 1, wherein the at least one partition factor is a number whose value reflects a tendency of a chemical lump within the complex organic product to partition or to be expelled.

11. A computer-implemented method for producing hydrocarbons from an oil and/or gas field, the method comprising:

computing using a computer a first approximation of an amount of generated petroleum that is retained with a complex organic product using a Threshold value and a Maximum Retention value;

revising using a computer the first approximation by approximating a process of chemical fractionation using at least one partition factor to create a revised approximation;

predicting petroleum production based on the revised approximation; and extracting hydrocarbons from the oil and/or gas field using the predicted petroleum production.

12. The computer-implemented method for producing hydrocarbons recited in claim 11, wherein the complex organic product comprises a kerogen.

13. The computer-implemented method for producing hydrocarbons recited in claim 11, wherein the first approximation is generated by modeling a closed system.

14. The computer-implemented method for producing hydrocarbons recited in claim 11, wherein the Threshold value and the Maximum Retention value describe a degree of swelling corresponding to an amount of bitumen the complex organic product can retain.

15. The computer-implemented method for producing hydrocarbons recited in claim 11, wherein at least one of the Threshold value and the Maximum Retention value are expressed in hydrogen index units.

16. The computer-implemented method for producing hydrocarbons recited in claim 11, wherein the first approximation represents the effects of thermodynamic parameters including a solubility parameter, a cross-link density, and a native swelling factor.

17. The computer-implemented method for producing hydrocarbons recited in claim 11, wherein the Threshold value and the Maximum Retention value respectively define a minimum and a maximum amount of bitumen that may be retained within the complex organic product as a function of thermal alteration.

18. The computer-implemented method for producing hydrocarbons recited in claim 11, wherein the Threshold value and the Maximum Retention value respectively define a minimum value of generated products below which there is no expulsion and a maximum amount of generated product that may be retained within the complex organic product.

19. The computer-implemented method for producing hydrocarbons recited in claim 11, wherein the at least one partition factor is a number whose value reflects a tendency of a chemical lump within the complex organic product to partition or to be expelled.

20. A tangible, non-transitory machine-readable medium comprising executable instructions which when executed on a computer, perform a method comprising:

computing a first approximation of an amount of generated petroleum that is retained with a complex organic product using a Threshold value and a Maximum Retention value;

revesing the first approximation by approximating a process of chemical fractionation using at least one partition factor to create a revised approximation; and predicting petroleum production based on the revised approximation.

* * * * *